US007136083B2

(12) United States Patent
Tezuka et al.

(10) Patent No.: US 7,136,083 B2
(45) Date of Patent: Nov. 14, 2006

(54) DISPLAY METHOD BY USING SUB-PIXELS

(75) Inventors: Tadanori Tezuka, Fukuoka-Ken (JP); Hiroyuki Yoshida, Fukuoka-Ken (JP); Bunpei Toji, Iizuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 756 days.

(21) Appl. No.: 09/908,164

(22) Filed: Jul. 18, 2001

(65) Prior Publication Data

US 2002/0008714 A1 Jan. 24, 2002

(30) Foreign Application Priority Data

Jul. 19, 2000 (JP) ..... 2000-219515
Jul. 19, 2000 (JP) ..... 2000-219516
Jul. 21, 2000 (JP) ..... 2000-220041
May 14, 2001 (JP) ..... 2001-142718

(51) Int. Cl.
*G09G 5/04* (2006.01)

(52) U.S. Cl. ..... 345/690; 345/88; 345/589; 345/668; 345/613; 345/671

(58) Field of Classification Search ..... 345/88, 345/83, 89, 147, 148, 150, 149, 152, 153, 345/137, 471, 472, 468, 87, 51, 611, 613, 345/502, 3.1–3.4, 40, 690, 696, 698, 597–605, 345/667–671, 589
See application file for complete search history.

(56) References Cited

U.S. PATENT DOCUMENTS 3,935,590 A * 1/1976 Kaji et al. ..... 348/656
4,236,175 A * 11/1980 Groothuis ..... 348/659
4,720,745 A 1/1988 DeForest et al.
4,725,828 A * 2/1988 Cowlishaw ..... 345/694
5,164,825 A * 11/1992 Kobayashi et al. ..... 348/441
5,334,996 A 8/1994 Tanigaki et al.
5,404,447 A 4/1995 Drako et al.
5,432,890 A 7/1995 Watanabe
5,450,208 A 9/1995 Murata
5,543,819 A 8/1996 Farwell et al.
5,623,593 A 4/1997 Spells, III
5,633,654 A 5/1997 Kennedy et al.
5,748,178 A * 5/1998 Drewry ..... 345/643

(Continued)

FOREIGN PATENT DOCUMENTS

EP 0 710 925 A2 5/1996

(Continued)

OTHER PUBLICATIONS

Markoff, John, "Microsoft's Cleartype Sets Off Debate on Originality", New York Times Online, Dec. 7, 1998, pp. 1-4.

(Continued)

*Primary Examiner*—Lun-Yi Lao
(74) *Attorney, Agent, or Firm*—Darby & Darby

(57) ABSTRACT

A display method includes obtaining three-times magnified image data, which is made up of sub-pixels and with which a raster image to be displayed currently is magnified by three in the first direction. A filtering process on the three-times magnified image data is based on factors that are weighed in accordance to the degrees of contribution to luminance of the three primary colors of R, G, and B. The weighted data are allocated to sub-pixels of the three-times magnified image data that have been subject to the filtering process. The sub-pixels are formed by the three light-emitting elements that form a pixel to thereby enable the display device to perform display.

8 Claims, 23 Drawing Sheets

U.S. PATENT DOCUMENTS

| | | | | |
|---|---|---|---|---|
| 5,768,490 | A | 6/1998 | Hersch et al. | |
| 5,821,913 | A | 10/1998 | Mamiya | |
| 5,852,443 | A | 12/1998 | Kenworthy | |
| 5,852,673 | A | 12/1998 | Young | |
| 5,910,805 | A | 6/1999 | Hickey et al. | |
| 6,008,820 | A | 12/1999 | Chauvin et al. | |
| 6,181,353 | B1 | 1/2001 | Kurisu | |
| 6,188,385 | B1 | 2/2001 | Hill et al. | |
| 6,219,011 | B1 | 4/2001 | Aloni et al. | |
| 6,219,025 | B1 | 4/2001 | Hill et al. | |
| 6,225,973 | B1 | 5/2001 | Hill et al. | |
| 6,236,390 | B1 | 5/2001 | Hitchcock | |
| 6,239,783 | B1 | 5/2001 | Hill et al. | |
| 6,239,789 | B1 * | 5/2001 | Sekizawa et al. | 345/173 |
| 6,243,055 | B1 | 6/2001 | Fergason | |
| 6,243,070 | B1 | 6/2001 | Hill et al. | |
| 6,278,434 | B1 | 8/2001 | Hill et al. | |
| 6,288,703 | B1 | 9/2001 | Berman et al. | |
| 6,299,930 | B1 | 10/2001 | Marotta et al. | |
| 6,342,896 | B1 | 1/2002 | Shetter et al. | |
| 6,356,278 | B1 | 3/2002 | Stamm et al. | |
| 6,360,023 | B1 | 3/2002 | Betrisey et al. | |
| 6,377,273 | B1 | 4/2002 | Lee et al. | |
| 6,384,839 | B1 | 5/2002 | Paul | |
| 6,396,505 | B1 | 5/2002 | Lui et al. | |
| 6,509,904 | B1 | 1/2003 | Siu | |
| 6,532,041 | B1 | 3/2003 | Monta et al. | |
| 6,542,161 | B1 | 4/2003 | Koyama et al. | |
| 6,563,502 | B1 | 5/2003 | Dowling et al. | |
| 6,608,632 | B1 | 8/2003 | Daly et al. | |
| 6,681,053 | B1 | 1/2004 | Zhu et al. | |
| 6,750,875 | B1 | 6/2004 | Keely | |
| 6,756,992 | B1 * | 6/2004 | Toji et al. | 345/613 |
| 6,775,420 | B1 | 8/2004 | Daly | |

FOREIGN PATENT DOCUMENTS

| | | | | |
|---|---|---|---|---|
| EP | 0 710 925 | A2 | | 5/1996 |
| EP | 1 158 485 | A2 | | 12/2001 |
| JP | 60-139090 | A | | 7/1985 |
| JP | 61-267714 | A | | 11/1986 |
| JP | 01-303890 | A | | 12/1989 |
| JP | 08-166778 | A | * | 6/1996 |
| JP | 2002099239 | A | * | 4/2002 |
| WO | 00/21066 | | | 4/2000 |
| WO | WO-00/21037 | A1 | | 4/2000 |
| WO | WO 00/21066 | | | 4/2000 |
| WO | WO-00/21067 | A1 | | 4/2000 |
| WO | WO-00/21068 | A1 | | 4/2000 |
| WO | WO-00/21070 | A1 | | 4/2000 |
| WO | WO 002/21066 | | | 4/2000 |
| WO | 00/42564 | | | 7/2000 |
| WO | WO 00/42564 | | | 7/2000 |
| WO | WO-00/57305 | A1 | | 9/2000 |
| WO | WO-01/09824 | A1 | | 2/2001 |
| WO | WO-01/09873 | A1 | | 2/2001 |

OTHER PUBLICATIONS

"Sub-pixel font rendering technology: implementation details", Dec. 8, 1999, pp. 1-4, XP002239840, http://grc.com/cttech.htm. How Sub-Pixel Font Rendering Works; "*Sub-Pixel* Font Rendering Technology How it Works" (pp. 1-7), and "*Sub-Pixel* Font Rendering Technology, Implementation Details" (pp.. 1-6).

* cited by examiner (a)

$$V(n)=(1/10)*V_{n-1}+(3/10)*V_n+(6/10)*V_{n+1}$$

(b)

$$V(n)=(3/10)*V_{n-1}+(6/10)*V_n+(1/10)*V_{n+1}$$

(c)

$$V(n)=(6/10)*V_{n-1}+(1/10)*V_n+(3/10)*V_{n+1}$$

$V(n)=(6/100)*V_{n-2}+(4/100)*V_{n-1}+(30/100)*V_n+(54/100)*V_{n+1}+(6/100)*V_{n+2}$ $V(n)=(3/100)*V_{n-2}+(27/100)*V_{n-1}+(60/100)*V_n+(7/100)*V_{n+1}+(3/100)*V_{n+2}$ $V(n)=(18/100)*V_{n-2}+(42/100)*V_{n-1}+(10/100)*V_n+(12/100)*V_{n+1}+(18/100)*V_{n+2}$ $V(n) = (1/30) * V_{n-2} + (4/30) * V_{n-1} + (10/30) * V_n + (9/30) * V_{n+1} + (6/30) * V_{n+2}$ $V(n) = (3/30) * V_{n-2} + (9/30) * V_{n-1} + (10/30) * V_n + (7/30) * V_{n+1} + (1/30) * V_{n+2}$ $V(n) = (6/30) * V_{n-2} + (7/30) * V_{n-1} + (10/30) * V_n + (4/30) * V_{n+1} + (3/30) * V_{n+2}$ $V(n)=(6/30)*V_{n-2}+(2/30)*V_{n-1}+(9/30)*V_n+(12/30)*V_{n+1}+(1/30)*V_{n+2}$ $V(n)=(1/30)*V_{n-2}+(6/30)*V_{n-1}+(18/30)*V_n+(2/30)*V_{n+1}+(3/30)*V_{n+2}$ $V(n)=(3/30)*V_{n-2}+(12/30)*V_{n-1}+(3/30)*V_n+(6/30)*V_{n+1}+(6/30)*V_{n+2}$ (a)

(b)

| address | V |
|---|---|
| 00000 | 0 |
| 00001 | 28 |
| 00010 | 57 |
| 00011 | 85 |
| ⋮ | ⋮ |
| 00110 | 142 |
| ⋮ | ⋮ |
| 11111 | 255 |

(c)

| address | R | G | B |
|---|---|---|---|
| 00000 | 0 | 0 | 0 |
| 00001 | 15 | 8 | 46 |
| 00010 | 138 | 18 | 31 |
| 00011 | 153 | 26 | 77 |
| ⋮ | ⋮ | ⋮ | ⋮ |
| 00110 | 214 | 171 | 56 |
| ⋮ | ⋮ | ⋮ | ⋮ |
| 11111 | 255 | 255 | 255 |

(d)

| address | R | G | B |
|---|---|---|---|
| 00000 | 0 | 0 | 0 |
| 00001 | 51 | 9 | 26 |
| 00010 | 77 | 60 | 34 |
| 00011 | 128 | 68 | 60 |
| ⋮ | ⋮ | ⋮ | ⋮ |
| 00110 | 162 | 145 | 119 |
| ⋮ | ⋮ | ⋮ | ⋮ |
| 11111 | 255 | 255 | 255 |

(e)

| address | R | G | B |
|---|---|---|---|
| 00000 | 0 | 0 | 0 |
| 00001 | 9 | 26 | 51 |
| 00010 | 102 | 17 | 51 |
| 00011 | 111 | 43 | 102 |
| ⋮ | ⋮ | ⋮ | ⋮ |
| 00110 | 179 | 170 | 77 |
| ⋮ | ⋮ | ⋮ | ⋮ |
| 11111 | 255 | 255 | 255 |

(a)

(b)

| address | V |
|---|---|
| 000 | 0 |
| 001 | 85 |
| 010 | 85 |
| 011 | 170 |
| ⋮ | ⋮ |
| 111 | 255 |

(c)

| address | R | G | B |
|---|---|---|---|
| 000 | 0 | 0 | 0 |
| 001 | 153 | 26 | 77 |
| 010 | 77 | 153 | 26 |
| 011 | 230 | 179 | 102 |
| ⋮ | ⋮ | ⋮ | ⋮ |
| 111 | 255 | 255 | 255 |

$$V(n)=(25*V_{n-2}+60*V_{n-1}+86*V_n+60*V_{n+1}+25*V_{n+2})>>8$$

$$V(n)=(5*V_{n-2}+16*V_{n-1}+22*V_n+16*V_{n+1}+5*V_{n+2})>>6$$

$$V(n)=(10*V_{n-2}+27*V_{n-1}+54*V_n+27*V_{n+1}+10*V_{n+2})>>7$$

Prior Art (b)

$$V(n) = (1/9) * V_{n-2} + (2/9) * V_{n-1} + (3/9) * V_n + (2/9) * V_{n+1} + (1/9) * V_{n+2}$$

DISPLAY METHOD BY USING SUB-PIXELS

BACKGROUND OF THE INVENTION

1. Field of the Invention

This invention concerns a display equipment, which performs display at sub-pixel precision based on an original image. The image not a vector image but is a raster image (pixel precision: in the case of a font, not a vector font but a raster font), and art related to this display equipment. To be more specific, this invention concerns a filtering technique to be used in the process of performing sub-pixel display.

2. Description of the Related Art

Display equipment that employs various types of display devices is well known and used in the past. Included among such display devices are color LCD's, color plasma displays, and other display devices, in which three light-emitting elements, which respectively emit light of the three primary colors of R, G, and B, are aligned in a fixed order in a first direction to form one pixel. A plurality of such pixels are aligned in the first direction to form one line. A plurality of such lines are aligned in a second direction, which is orthogonal to the first direction, to form the display screen.

There are also many display devices, such as the display device in a portable telephone, mobile computer, etc., which have a relatively narrow display screen and in which detailed display is difficult to achieve. When the display of a small character, photograph, or complex picture, etc. is attempted with such a display device, part of the image tends to become smeared and unclear.

Literature (titled: "Sub Pixel Font Rendering Technology") concerning sub-pixel display, which makes use of each pixel being formed of the three light-emitting elements for R, G, and B to improve the clarity of the display on a narrow screen, is being disclosed on the Internet. The present inventors have checked this literature upon downloading it from a website published by Gibson Research Corporation.

This art is described with reference to FIGS. 23 to 28. In the following description, the image of the alphabetic character, "A", is used as an example of the image to be displayed.

Referring to FIG. 23, each single line is composed of a plurality of pixels, each of which is formed from three light-emitting elements aligned along the direction of the line. The horizontal direction in FIG. 23 (the direction in which the light-emitting elements of the three primary colors of R, G, and B are aligned) is referred to as the first direction. The orthogonal, vertical, direction is referred to as the second direction. Any order of alignment of the light-emitting elements besides R, G, and B is possible. The prior art and the present invention are applied likewise even if the order of alignment is changed.

A pixel (set of three light-emitting elements) is aligned in a single row in the first direction to arrange a single line. A plurality of lines are aligned in the second direction to arrange the display screen.

With this sub-pixel technology, the original image is, for example, an image such as shown in FIG. 24. In this example, the character, "A", is displayed over an area of seven pixels each in the horizontal and vertical directions. Where each of the R, G, and B light-emitting elements is handled as a single pixel in order to perform sub-pixel display, a font, which has a definition of three times that of the above-described image in the horizontal direction, is prepared, as shown in FIG. 25, over an area of 21 (=7×3) pixels in the horizontal direction and 7 pixels in the vertical direction.

Then as shown in FIG. 26, a color is determined for each of the pixels in FIG. 24 (i.e. not the pixels of FIG. 25 but the pixels of FIG. 24). However, since color irregularities occur if display is performed as it is, a filtering process, using factors such as shown in FIG. 27(*a*), is applied. Factors concerning the luminance are shown in FIG. 27(*a*). The luminance values of the respective sub-pixels are adjusted by multiplying a factor, for example, of 3/9 in the case of the central target sub-pixel, of 2/9 in the case of an adjacent sub-pixel, and of 1/9 in the case of the sub-pixel next to the adjacent sub-pixel.

These factors are now described in more detail with reference to FIG. 28. In FIG. 28, the "*" indicates that the sub-pixel may be any of the three primary color light-emitting elements for R, G, and B. The determination of the factors is started from the first stage at the top and proceeds to the second stage and the third stage. The factor of the central target sub-pixel is determined at the center of the third stage.

In proceeding from the first stage to the second stage, energy is distributed uniformly among the three primary color light-emitting elements for R, G, and B, that is, the factor of the first stage is just 1/3. Likewise, energy is distributed uniformly in proceeding from the second stage to the third stage, that is, the factor of the second stage is also just 1/3.

Since the central sub-pixel is reached from the first stage via a total of three paths at the center, left, and right sides of the second stage, the synthetic factor (in which the factors of the first and second stages are synthesized) of the central sub-pixel is $1/3\times1/3+1/3\times1/3+1/3\times1/3=3/9$. Also, since a sub-pixel adjacent the central pixel is reached via two paths, the synthetic factor thereof is $1/3\times1/3+1/3\times1/3=2/9$. Since there is only one path for a next adjacent sub-pixel, the synthetic factor thereof is $1/3\times1/3=1/9$.

(1) First Problem

However in actuality, each of the three primary color light-emitting elements of R, G, and B differ in the degree that they contribute to luminance. Part of this difference is due to source brightness, and part is due to the response of the eye to different colors.

Thus when a filtering process for sub-pixel display by the prior art is performed, although color irregularities are eliminated, the entire image becomes blurry and the display quality is poor.

(2) Second Problem

With the prior art, since the denominator of a factor is 9, a factor cannot provide an integer aliquot in general (aliquot refers to a number that contains an exact number of some other number, i.e., one number exactly divisible by another number without a remainder). Thus when a factor is approximated by an integer, the error is too great to ignore.

Thus in performing the filtering process for sub-pixel display by the prior art, floating decimal point computation is necessary. Floating decimal point computation disables high-speed integer computation and makes it difficult to incorporate the process into hardware.

(3) Third Problem

Also conventionally, an anti-aliasing process is performed to improve the visibility of an image in a narrow display area. However, since the anti-aliasing process blurs the image as a whole in an attempt to alleviate jaggedness, image quality is degraded by the blurring of the image.

With regard to this point, visibility is improved by the application of the above-described sub-pixel technique.

However, there have been demands for even better visibility in the display results achieved by the application of the sub-pixel technique.

OBJECTS AND SUMMARY OF THE INVENTION

A first object of this invention is to provide a display method by which the color irregularities in sub-pixel display are eliminated and display of high quality is performed to thereby resolve the first problem. At the same time, this invention provides a technique by which sub-pixel display of high quality is made at high speed.

A second object of this invention is to provide a display method, which enables the elimination of the color irregularities of sub-pixel display and enables high-speed computation to thereby resolve the second problem.

A third object of this invention is to provide a display method by which an image is displayed smoothly with low blurring to thereby resolve the third problem.

(1) In order to achieve the first object, a first aspect of this invention provides in a method of performing display with a display device, with which three light emitting elements, which respectively emit light of the three primary colors of R, G, and B, are aligned in a fixed order to form one pixel, such pixels are aligned in the first direction to form one line, and a plurality of such lines are provided in a second direction, that is orthogonal to the first direction, to form a display screen. The display method consists of a step of obtaining three-times magnified image data, which are formed of sub-pixels and with which a raster image to be displayed currently, is magnified by three in the first direction, a step of performing a filtering process on the three-times magnified image data based on factors that are weighed in accordance to the degrees of contribution to luminance of the three primary colors of R, G, and B, and a step of allocating the sub-pixels of the three-times magnified image data that have been subject to the filtering process to the three light-emitting elements that form a pixel to thereby make the display device perform display.

A second aspect of this invention provides in a method of performing display with a display device, with which three light-emitting elements, which respectively emit light of the three primary colors of R, G, and B, are aligned in a fixed order in a first direction to form one pixel, such pixels are aligned in the first direction to form one line, and a plurality of such lines are provided in a second direction that is orthogonal to the first direction to form a display screen. The display method comprised of a step of obtaining three-times magnified image data, which are formed of sub-pixels and with which a raster image to be displayed currently is magnified by three in the first direction, a step of performing a filtering process on the three-times magnified image data based on factors that ignore the degrees of contribution to luminance of the three primary colors of R, G, and B, a step of performing, based on factors that are weighed in accordance to the degrees of contribution to luminance of the three primary colors of R, G, and B, a correction process on the sub-pixels ofthe three-times magnified image data that have been subject to the filtering process, and a step of allocating the sub-pixels of the three-times magnified image data that have been subject to the correction process to the three light-emitting elements that form a pixel to thereby make the display device perform display.

By the above arrangements, sub-pixel display, in which the degrees of contribution to luminance of the three primary colors of R, G, and B are taken into account, is performed and color irregularities are reduced to improve the quality of sub-pixel display in comparison to the prior art.

With a display method of a third aspect of this invention, the filtering process is performed in one stage.

Since this arrangement takes into account the degrees of contribution to luminance of the three primary colors R, G, and B, color irregularities are adequately limited even by a single-stage filtering process. Moreover, the processing speed is improved by a simple process.

With a display method of a fourth aspect of this invention, the filtering process is performed in two stages.

With this arrangement, the degrees of contribution to luminance of the three primary colors R, G, and B, are taken into account over two stages to enable a fine-tuned filtering process to be performed. Color irregularities are thus further restricted to enable additional improvement in the display quality.

With a display method of a fifth aspect of this invention, at least part of the factors are set so that R:G:B=3:6:1.

By this arrangement, luminance adjustment that matches the actual circumstances is performed.

With a display method of a sixth aspect of this invention, at least part of the factors are set based on measured values resulting from the measurement of the characteristics of the abovementioned display device.

By this arrangement, the unique characteristics of a display device are accounted for in the filtering process.

With a display method of a seventh aspect of this invention, the filtering process is performed on a total of three sub-pixels centered about a target sub-pixel.

With this arrangement, since the degrees of contribution to luminance of the three primary colors R, G, and B, are taken into account, color irregularities are adequately restricted even by a filtering process performed on a total of three sub-pixels. Moreover, the processing speed is improved by a simple process.

With a display method of an eighth aspect of this invention, the filtering process is performed on a total of five sub-pixels centered about a target sub-pixel.

With this arrangement, since the degrees of contribution to luminance of the three primary colors R, G, and B, are taken into account across a wide range and a fine-tuned filtering process is performed, color irregularities are restricted further to enable additional improvement in the display quality.

A ninth aspect of this invention provides a display method, with which filter results, obtained in accordance with a pattern of the values of a total of n (where n is a natural number) sub-pixels, which are aligned in the first direction and are centered about a target sub-pixel of a three-times magnified image that is input, are prepared in advance in a filter results storage means and which includes a step of obtaining three-times magnified image data, which are formed of sub-pixels and with which a binary raster image to be currently displayed is magnified by three in the first direction, a step of executing a filtering process by referencing the filter results storage means, and a step of allocating the sub-pixels of the three-times magnified image data that have been subject to the filtering process to the three light-emitting elements that form a pixel to thereby enable the display device perform display.

By this arrangement, the filtering process necessary for sub-pixel display is performed by referencing the filter results storage means to enable performing sub-pixel display at high speed.

With a display method of a tenth aspect of this invention, the referencing of the filter results storage means is performed using the values of a total of three sub-pixels centered about the target sub-pixel.

By this arrangement, the quality of the filtering process by the referencing of the filter results storage means is kept the same as the quality of the filtering process performed on a total of three sub-pixels centered about the target sub-pixel. This is adequate in terms of practical use especially in the case where an image of low gradation is to be displayed since color irregularities are not conspicuous in this case. This saves storage area and enables high speed processing reducing the amount of filter results to be referenced.

With a display method of an eleventh aspect of this invention, the referencing of the filter results storage means is performed using the values of a total of five sub-pixels centered about the target sub-pixel.

With a display method of a twelfth aspect of this invention, the referencing of the filter results storage means is performed using the values of a total of seven sub-pixels centered about the target sub-pixel.

By these arrangements, the quality of the filtering process by referencing the filter results storage means is kept the same as the quality of the filtering process performed on a total of five or seven sub-pixels centered about the target sub-pixel. These arrangements thus enable accommodation for high-gradation image displays, in which color irregularities tend to become conspicuous.

With a display method of a thirteenth aspect of this invention, the raster image that is input is binary data. Since the number of conditions a total of three sub-pixels centered about the target sub-pixel can take on is 2 to the 3rd power, 8 sets of values in the filter results storage means are necessary and adequate.

With a display method of a fourteenth aspect of this invention, the raster image that is input is binary data. Since the number of conditions a total of five sub-pixels centered about the target sub-pixel can take on is 2 to the 5th power, 32 sets of values in the filter results storage means are necessary and adequate.

With a display method of a fifteenth aspect of this invention, since the number of conditions a total of seven sub-pixels centered about the target sub pixel can take on is 2 to the 7th power, 128 sets of values in the filter results storage means are necessary and adequate.

By these arrangements, the number of filter results to be stored in the filter results storage means is reduced to enable savings in storage area as well as to achieve significant reduction in the amount of computation to be performed. This permits realization of a high-speed filter process.

With a display method of a sixteenth aspect of this invention, the filter results stored in the filter results storage means are determined based on factors that are weighted in accordance to the degrees of contribution to luminance of the three primary colors of R, G, and B.

By this arrangement, the process is completed practically by just referencing the storage means to a enable significant increase in processing speed. Moreover, sub-pixel display, with which the degrees of contribution to luminance of the three primary colors R, G, and B, are taken into account, is performed and color irregularities are restricted to enable further improvement in the sub-pixel display quality in comparison to the prior art.

With a display method of a seventeenth aspect of this invention, the target sub-pixel is renewed three sub-pixels at a time.

With this arrangement, the filtering process is performed in a batch for one pixel at a time and the amount of processing is one third of that required where renewal is performed one sub-pixel at a time. This enables even further increases in the processing speed.

With a display method of a eighteenth aspect of this invention, the values stored in the filter results storage means are values with which at least one of either a foreground color or a background color is blended.

By this arrangement, the case where at least one of either the foreground color or background color is displayed in color is accommodated for.

(2) In order to achieve the second object, a nineteenth aspect of this invention provides in a method of performing display with a display device, in which three light-emitting elements, which respectively emit light of the three primary colors of R, G, and B, are aligned in a fixed order in a first direction to form one pixel. A plurality of such pixels are aligned in the first direction to form one line. A plurality of such lines are provided in a second direction that is orthogonal to the first direction to form a display screen. The display method is comprised of a step of obtaining three-times magnified image data, which are formed of sub-pixels and with which a raster image to be displayed currently is magnified by three in the first direction, a step of performing a filtering process on the three-times magnified image data based on factors with which the denominator is a power of 2, and a step of allocating the sub-pixels of the three-times magnified image data that have been subject to the filtering process to the three light-emitting elements that form a pixel to thereby make the display device perform display.

By this arrangement, not only can color irregularities in sub-pixel display be reduced but high-speed computation by multiplication and addition of integers and bit shifting is enabled. This arrangement can also be realized readily in the form of hardware.

(3) In order to achieve the third object, a twenty third aspect of this invention provides a display method comprised of a step of obtaining three-times magnified image data, which are formed of sub-pixels and with which a raster image to be displayed currently is magnified by three in the first direction in which the light-emitting elements of R, G, and B are aligned, a step of subjecting the three-times magnified image data to a filtering process in the first direction, a step of subjecting the three-times magnified data that have been subject to the filtering process to an anti-aliasing process in just the second direction, and a step of allocating the sub-pixels of the three-times magnified image data that have been subject to the anti-aliasing process to the three light-emitting elements that form a pixel to thereby make the display device perform display.

By this arrangement, the blurring is lessened and yet the jaggedness is reduced to provide good visibility.

With a display method of a twenty fourth aspect of this invention, the filtering process is based on factors that are weighed in accordance to the degrees of contribution to luminance of the three primary colors of R, G, and B.

By this arrangement, sub-pixel display, in which the degrees of contribution to luminance of the three primary colors of R, G, and B are taken into account, is performed and color irregularities are reduced to improve the quality of sub-pixel display in comparison to the prior art.

With a display method of a twenty fifth aspect of this invention, the filtering process is performed in one stage.

Since this arrangement takes into account the degrees of contribution to luminance of the three primary colors R, G, and B, color irregularities are restricted adequately even by a single-stage filtering process, and moreover, the processing speed is improved by a simple process.

With a display method of a twenty sixth aspect of this invention, the filtering process is performed in two stages.

With this arrangement, the degrees of contribution to luminance of the three primary colors R, G, and B, are taken into account over two stages to enable a fine-tuned filtering process to be performed. Color irregularities can thus be restricted further to enable further improvement of the display quality.

With a display method of a twenty seventh aspect of this invention, at least part of the factors are set so that R:G:B=3:6:1.

By this arrangement, luminance adjustment that matches the actual circumstances is performed.

With a display method of a twenty eighth aspect of this invention, the filtering process is performed on a total of three sub-pixels centered about a target sub-pixel.

With this arrangement, since the degrees of contribution to luminance of the three primary colors R, G, and B, are taken into account, color irregularities are restricted adequately even by a filtering process performed on a total of three sub-pixels, and moreover, the processing speed is improved by a simple process.

With a display method of a twenty ninth aspect of this invention, the filtering process is performed on a total of five sub-pixels centered about a target sub-pixel.

With this arrangement, since the degrees of contribution to luminance of the three primary colors R, G, and B, are taken into account across a wide range and a fine-tuned filtering process are performed, color irregularities are restricted further to enable further improvement of the display quality.

The above, and other objects, features and advantages of the present invention will become apparent from the following description read in conjunction with the accompanying drawings, in which like reference numerals designate the same elements.

BRIEF DESCRIPTION OF THE DRAWINGS

FIGS. 9(*b*), (*c*), (*d*), and (*e*) are example diagrams of the table in the third embodiment of this invention.

FIGS. 10(*b*) and (*c*) are example diagrams of the table in the third embodiment of this invention.

FIG. 22(*c*) is an example diagram of a display by the seventh embodiment of the present invention.

FIG. 27(*b*) is an example diagram of the filtering process results of the prior art.

DETAILED DESCRIPTION OF THE PREFERRED EMBODIMENTS

First and Second Embodiments

Figure 1:
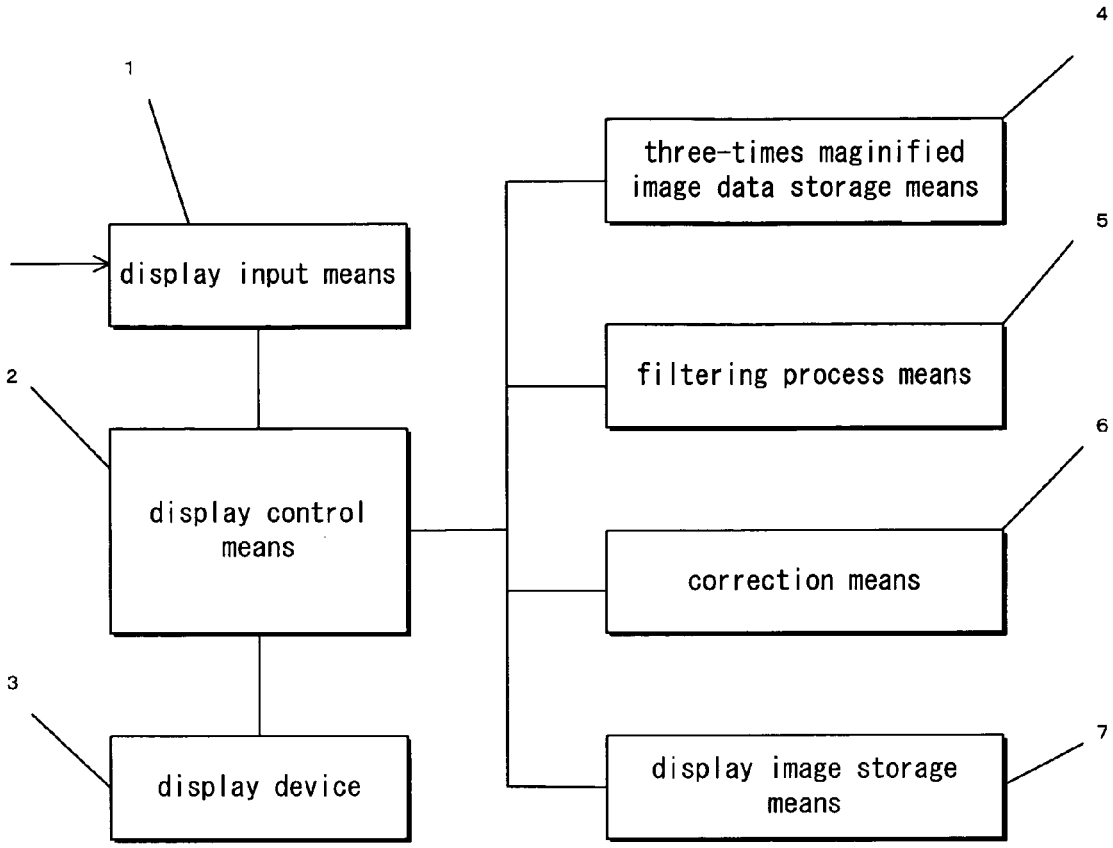
FIG. 1 is a block diagram of a display equipment of first and second embodiments of this invention.

Referring to FIG. 1, a display information input means 1 of the first and second embodiments of the invention inputs display information. A display image is stored in a display image storage means 7, which may be, for example, a VRAM. A display control means 2 controls the various elements of FIG. 1 to enable a display device 3 to perform display based on a display image, which is stored in the display image storage means 7 for sub-pixel precision display.

In the display device 3, three light-emitting elements, which respectively emit light of the three primary colors of R, G, and B, are aligned in a fixed order in a first direction to form one pixel. A plurality of such pixels are aligned in the first direction to form one line. A plurality of such lines are aligned in a second direction, which is orthogonal to the first direction, to form the display screen. To be more specific, the display device 3 may be formed of a color LCD or color plasma display, etc., and includes a suitable driver (not shown) which drives the respective elements of the color LCD or color plasma display, etc.

A three-times magnified image data storage means 4 stores a three-times magnified image (sub-pixel image corresponding to the three light-emitting elements for R, G, and B) corresponding to the display information input from the display information input means 1.

A filtering process means 5 performs a filtering process on the three-times magnified image stored in the three-times magnified image data storage means 4 and stores the resulting image as the processing result in the display image storage means 7.

Figure 2:
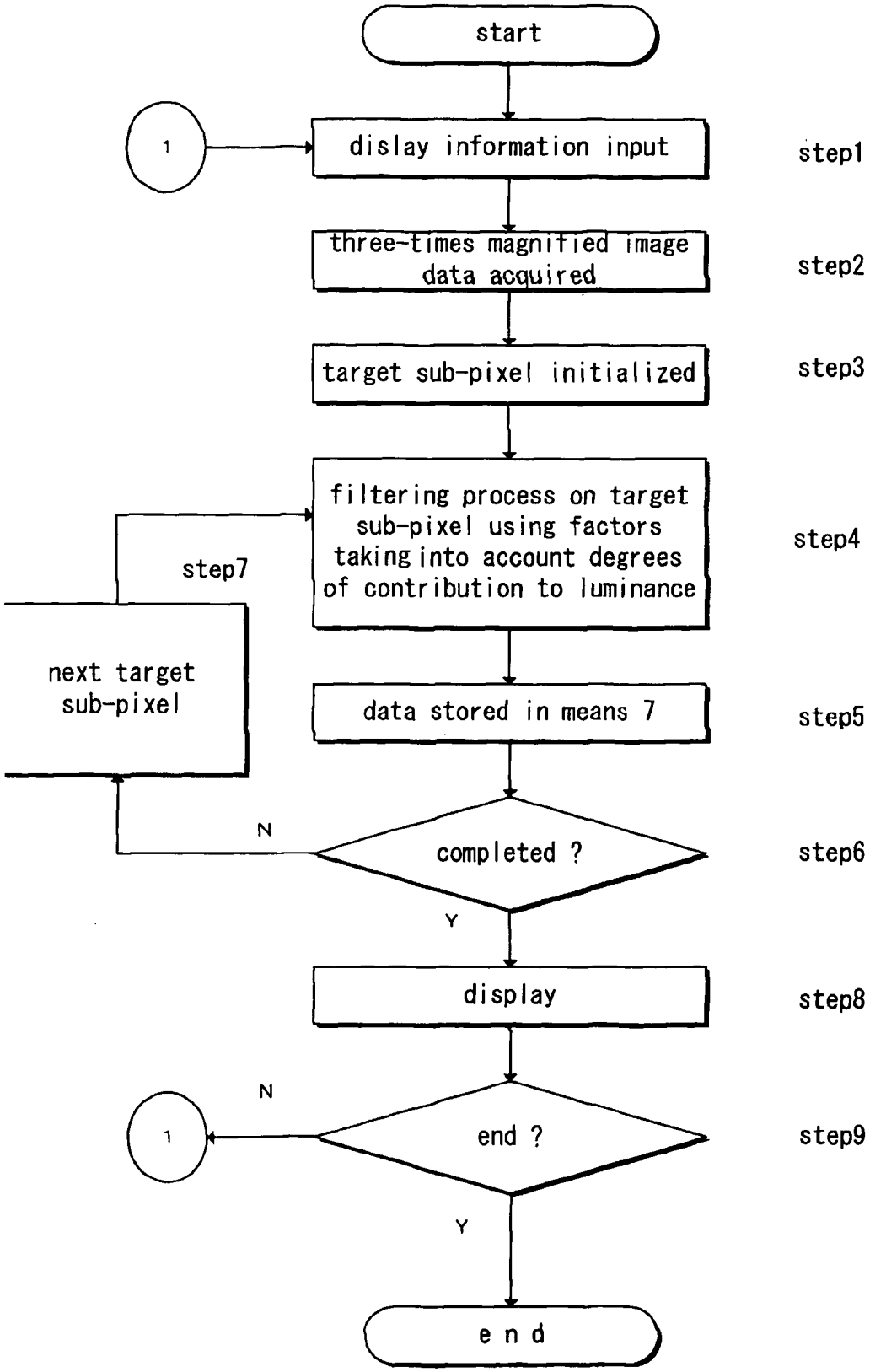
FIG. 2 is a flowchart for the display equipment of the first embodiment of this invention.

In the first embodiment, shown in FIG. 2, the filtering process means 5 performs the filtering process using factors that take into account the degrees of contribution to luminance of the respective light-emitting elements for R, G, and B. On the contrary, in the second embodiment, the filtering process is performed using factors that ignore the degrees of contribution to luminance.

First Embodiment

A description on the factors used in the filtering process of the first embodiment and the correction process of the second embodiment are described with reference to FIGS. 4(*a*)–(*c*) to 7(*a*)–(*c*).

Figure 4:
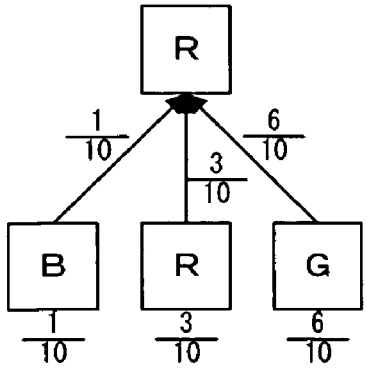
FIGS. 4(*a*), (*b*), and (*c*) are explanatory diagrams concerning the factors used in the first and second embodiments of this invention.
Figure 4:
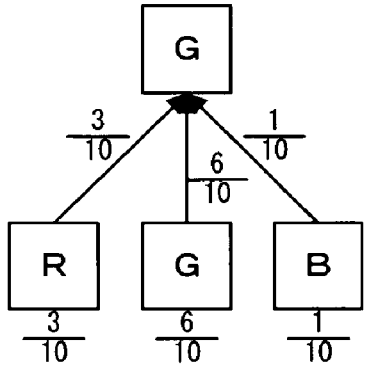
Figure 4:
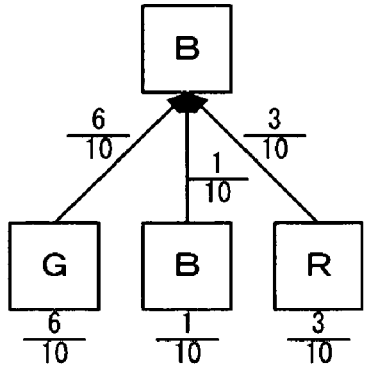

The factors for a filtering process with a single stage are shown in FIG. 4. Here, for one pixel formed of the three light-emitting elements (sub-pixels) of R, G, and B, the degrees of contribution to luminance are such that R:G:B=3:6:1.

If, as shown in FIG. 4(*a*), the target sub-pixel is an R sub-pixel, since the sub-pixel to its left is a B sub-pixel and the sub-pixel to the right is a G sub-pixel, energy collection is performed so that, for example, a factor of 1/10 is allocated to the B sub-pixel from the left (one sub-pixel prior to the target sub-pixel, n−1), 3/10 is allocated from the R sub-pixel, which is the target sub-pixel, and 6/10 is allocated from the G sub-pixel to the right (one sub-pixel after the target sub-pixel, n+1).

Thus if the respective pixel values V are expressed using a suffix, the value V(n) after the degrees of contribution to luminance are taken into account is such that $V(n)=(1/10)\times V_{n-1}+(3/10)\times V_n+(6/10)\times V_{n+1}$.

Likewise, the filtering process when the target sub-pixel is a G sub-pixel is shown in FIG. 4(*b*). The filtering process when the target sub-pixel is a B sub-pixel is shown in FIG. 4(*c*).

As is clear from FIGS. 4(*a*)–(*c*), if just the factors of the first stage are used, the factors are applied to a total of three sub-pixels centered about the target sub-pixel.

The factors for a two-stage filtering process are now described with reference to FIGS. 5(*a*)–(*c*). The first part of the two-stage process is exactly the same as that shown in FIGS. 4(*a*)–(*c*). When the target sub-pixel is R, since the order of sub-pixels in the stage below the B sub-pixel that branches from the target sub-pixel is GBR as shown in FIG. 5(*a*), energy collection is performed by allocating factors of 6/10, 1/10, and 3/10 in that order from the left side.

Likewise, since the order of sub-pixels in the stage below the R sub-pixel that branches from the target sub-pixel is BRG, energy collection is performed by allocating factors of 1/10, 3/10, and 6/10 in that order from the left side. Also, for the G sub-pixel that branches from the target sub-pixel, since the order of sub-pixels in the stage below is RGB, energy collection is performed by allocating factors of 3/10, 6/10, and 1/10 in that order from the left side.

Figure 5:
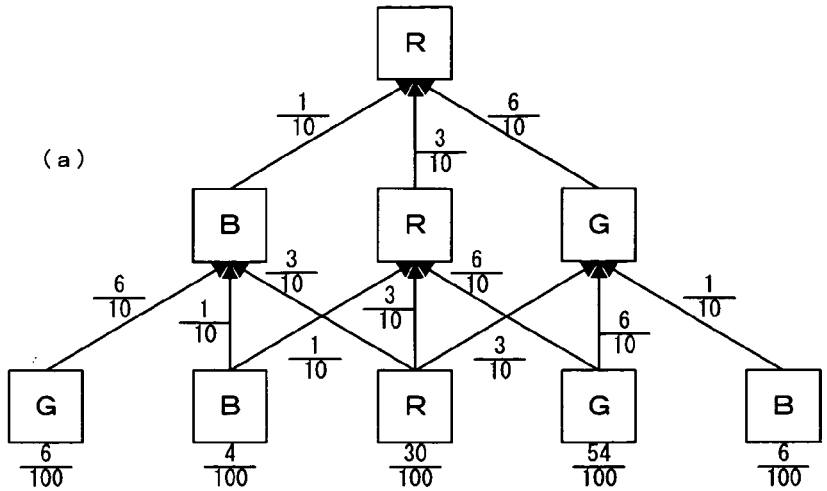
FIGS. 5(*a*), (*b*), and (*c*) are explanatory diagrams concerning the factors used in the first and second embodiments of this invention.
Figure 5:
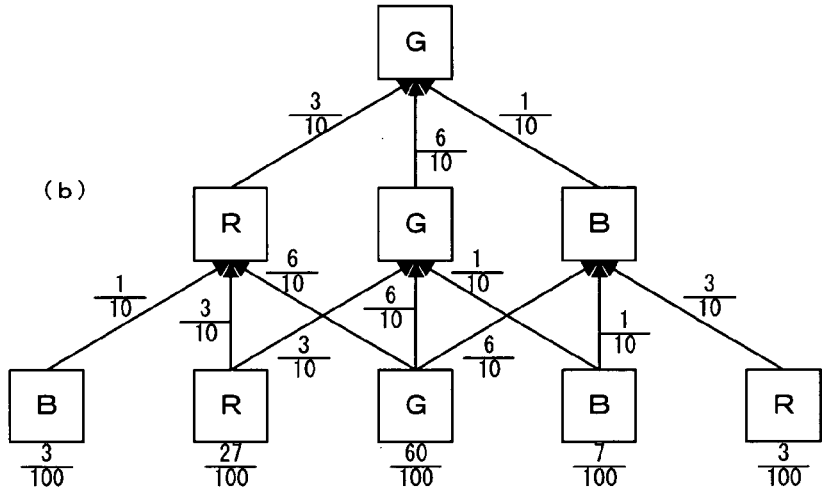
Figure 5:
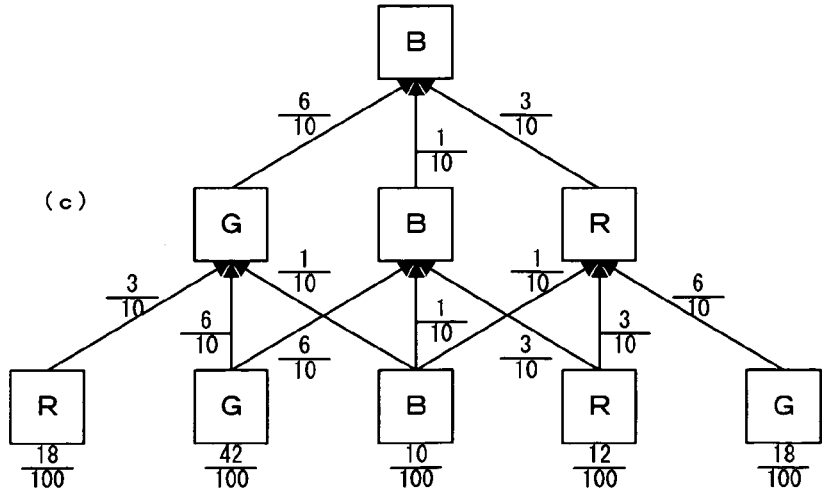

As a result, the hierarchy shown in FIG. 5(*a*) is formed. With regard to the R sub-pixel (target sub-pixel, n) at the center of FIG. 5(*a*), there are three pathways, passing through the B, R, and G sub-pixels, respectively, of the upper stage that lead to this target sub-pixel. The factor for the value Vn of the target sub-pixel will thus be $(1/10)\times(3/10)+(3/10)\times(3/10)+(6/10)\times(3/10)=30/100$.

The factor for the other sub-pixels for the lowermost stage are determined in like manner so that the value V(n) after the degrees of contribution to luminance are taken into account is $$V(n)=(6/100)\times V_{n-2}+(4/100)\times V_{n-1}+(30/100)\times V_n+(54/100)\times V_{n+1}+(6/100)\times V_{n+2}.$$

Likewise, the filtering process when the target sub-pixel is a G sub-pixel is shown in FIG. 5(*b*). The filtering process when the target sub-pixel is a B sub-pixel is shown in FIG. 5(*c*).

As is clear from FIG. 5, when factors of two stages are used, the factors are applied to a total of five sub-pixels centered about the target sub-pixel.

Figure 6:
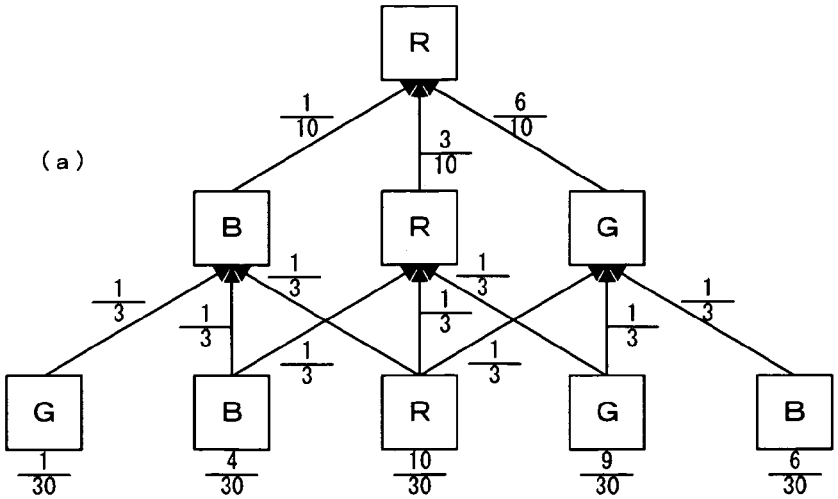
FIGS. 6(*a*), (*b*), and (*c*) are explanatory diagrams concerning the factors used in the first and second embodiments of this invention.
Figure 6:
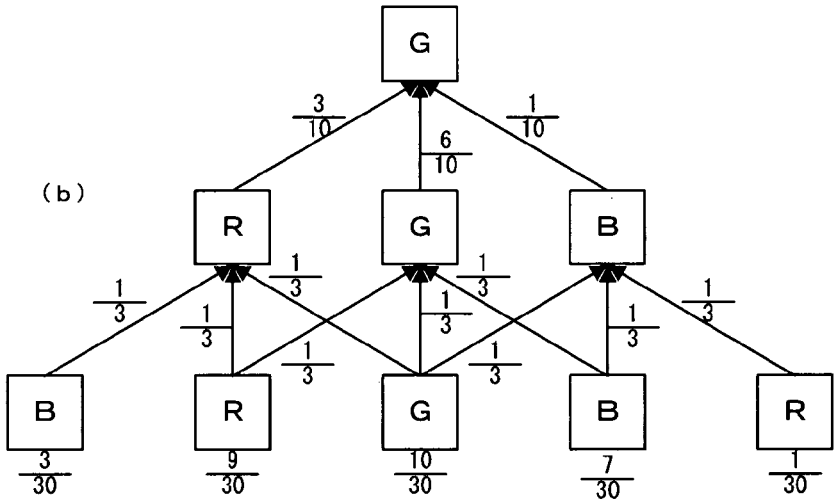
Figure 6:
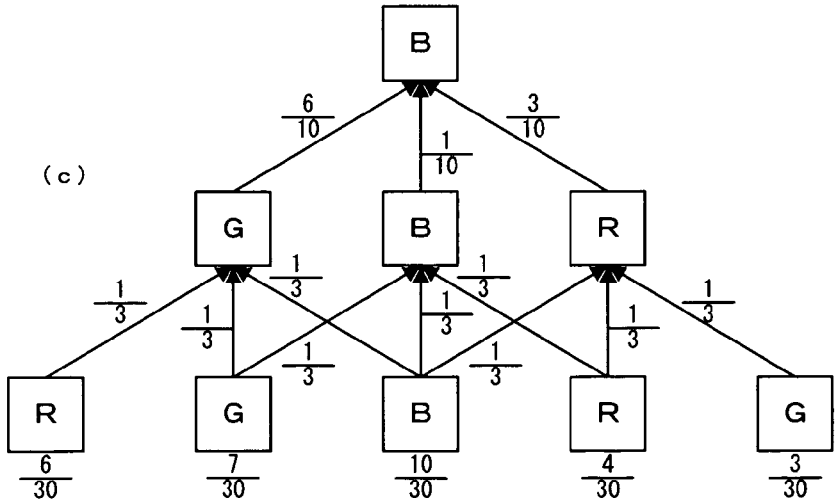
Figure 7:
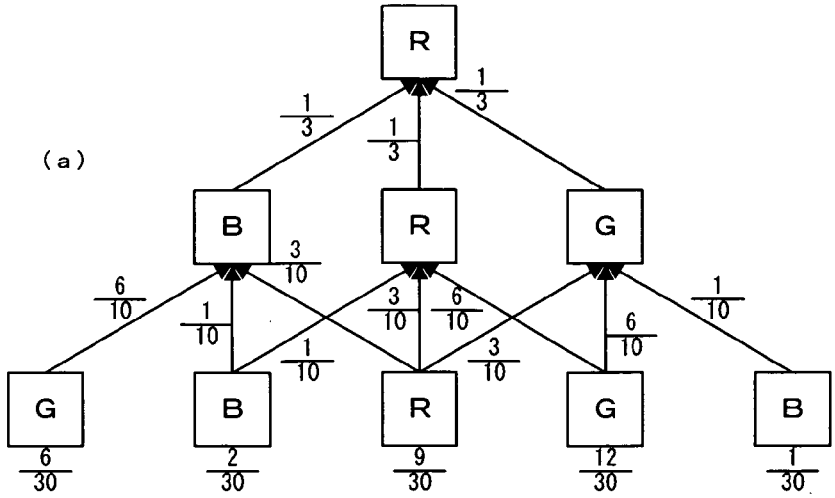
FIGS. 7(*a*), (*b*), and (*c*) are explanatory diagrams concerning the factors used in the first and second embodiments of this invention.
Figure 7:
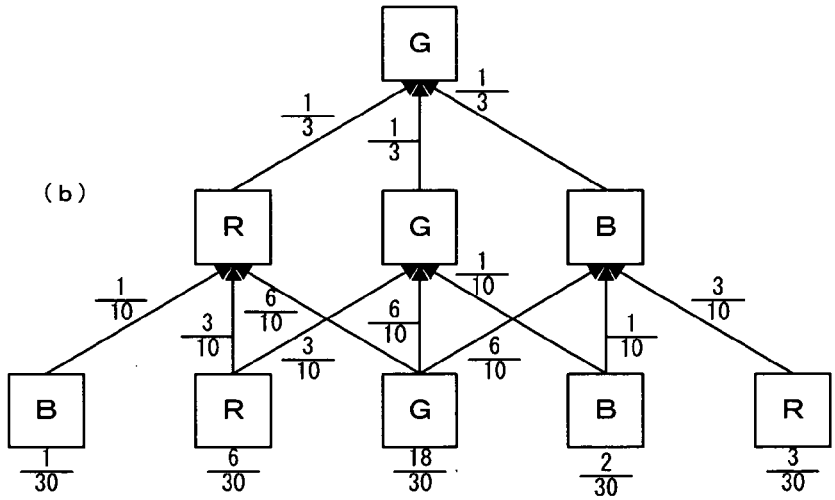
Figure 7:
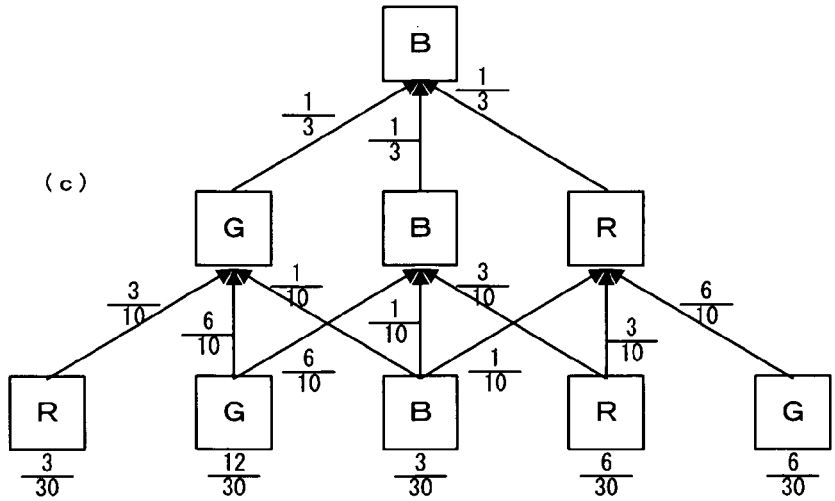

As examples of modifications of the above, those shown in FIG. 6(*a*)–(*c*) (where equal factors of (1/3) are allocated to the second stage) and in FIG. 7(*a*)–(*c*) (where equal factors of (1/3) are allocated to the first stage) is given. Even when equal allocation is performed on a part of the stages as in these examples, if factors that reflect the degrees of contribution to luminance are used in the other stages, this is adequate for practical purposes in many cases. This invention also includes cases where the above is applied to three or more stages.

Also, instead of using factors such that R:G:B=3:6:1 as in the above-described case, the characteristics of the display device may be measured and factors may be set based on the measured values. The characteristics unique to a display device can thereby be taken into account in the filtering process to achieve further improvement of the display quality.

Based on the above description, the flow of the display method of the first embodiment of this invention is now described with reference to FIG. 2. First, in step 1, the display information are input to the display information input means 1. The three-times magnified image (sub-pixel image) corresponding to the input display information is then taken from the three-times magnified image data storage means 4 (step 2). This image is typically raster font data.

Next in step 3, the display control means 2 initializes the target sub-pixel in the acquired three-times magnified image to the initial position at the upper left. In step 4, the filtering process means 5 performs the filtering process on the target sub-pixel using factors that take into account the degrees of contribution to luminance of the R, G and B sub-pixels. Here, the factors of any of FIGS. 4(*a*)–(*c*) to 7(*a*)–(*c*) may be used as the filtering process factors.

After completion of the filtering process, the filtering process means 5 returns the processed image data to the display control means 2. The display control means 2 stores the received data in the display image storage means 7 (step 5).

The display control means 2 repeats the processes from step 4 to step 5 while renewing the target sub-pixel (step 7) until the process is completed for all target sub-pixels (step 6).

When these repeated processes are completed, the display control means 2 allocates, on the basis of the display image stored in the display image storage means 7, the three-times magnified pattern to the three light emitting elements that form one pixel of the display device 3 and enables the display device 3 to perform display (at the sub-pixel precision) (step 8).

Then if the display is not completed (step 9), the display control means 2 returns the process to step 1.

Second Embodiment

Figure 3:
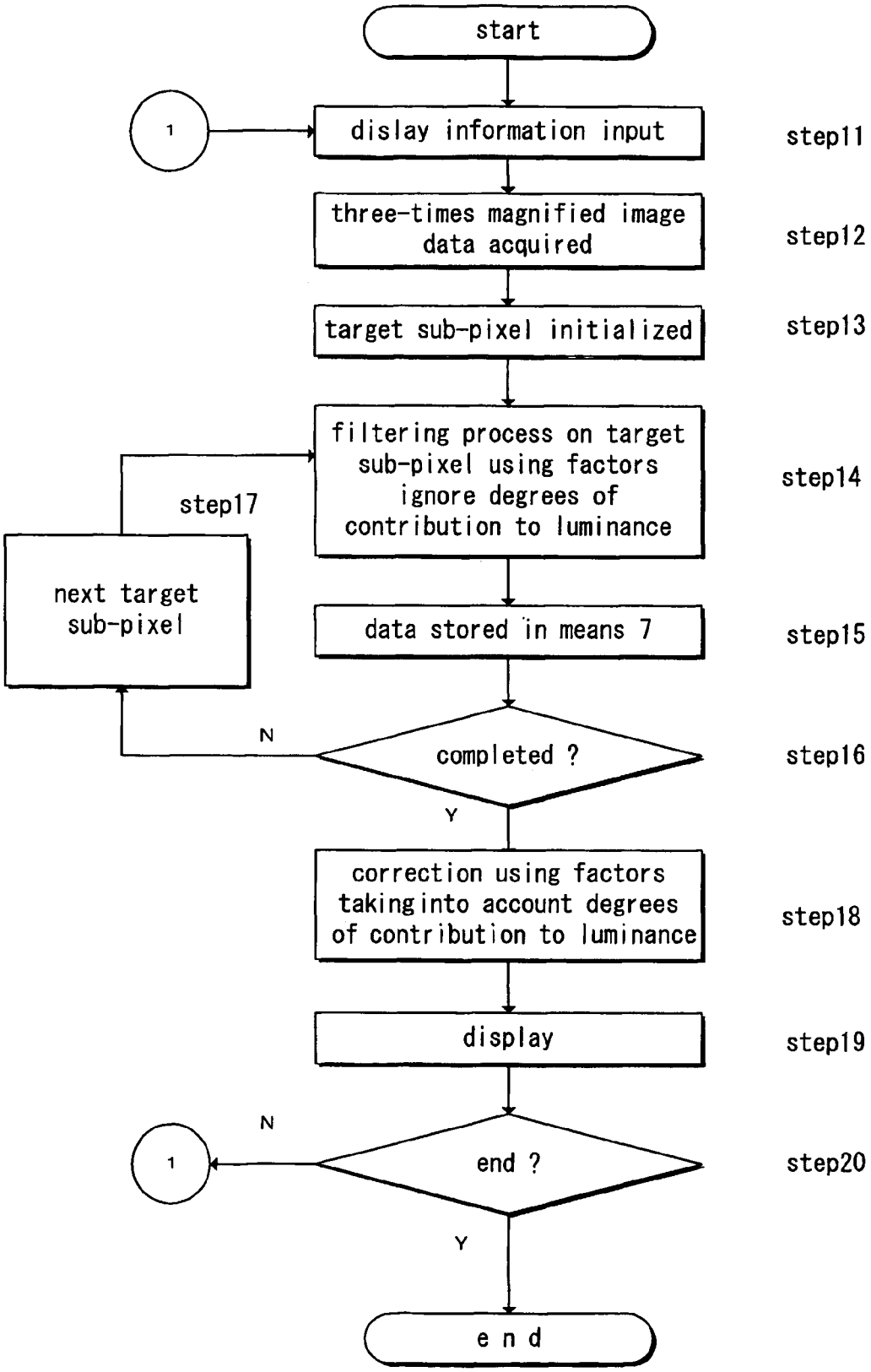
FIG. 3 is a flowchart for the display equipment of the second embodiment of this invention.

The flow of the display method of the second embodiment of this invention is now described with reference to FIG. 3. First, in step 11, the display information is input to the display information input means 1.

The three-times magnified image (sub-pixel image) corresponding to the input display information is then taken from the three-times magnified image data storage means 4 (step 12).

Next in step 13, the display control means 2 initializes the target sub-pixel in the acquired three-times magnified image to the initial position at the upper left. In step 14, the filtering process means 5 performs the filtering process on the target sub-pixel using factors that ignore the degrees of contribution to luminance.

After completion of the filtering process, the filtering process means 5 returns the processed image data to the display control means 2. The display control means 2 stores the received data in the display image storage means 7 (step 15).

The display control means 2 repeats the processes from step 14 to step 15 while renewing the target sub-pixel (step 17) until the process is completed for all target sub-pixels (step 16).

When these repeated processes are completed, the display control means 2 enables a correction means 6 to perform correction on the three-times magnified image in the display image storage means 7 (step 18). The correction means 6 performs a filtering process on all sub-pixels using factors that take into account the degrees of contribution to luminance (the factors of any of FIGS. 4(*a*)–(*c*) to 7(*a*)–(*c*)).

When the correction process is completed, the display control means 2 allocates, on the basis of the display image stored in the display image storage means 7, the three-times magnified pattern to the three light emitting elements that form one pixel of the display device 3 and enables the display device 3 to perform display (at the sub-pixel precision) (step 19).

Then if the display has not been completed (step 20), the display control means 2 returns the process to step 1.

The above-described first and second embodiments provide the following effect.

That is, since sub-pixel display is performed while distributing energy in accordance with the degrees of contribution to luminance of the three primary colors of R, G, and B, sub-pixel display is performed with few color irregularities and at high quality.

Third Embodiment

The third embodiment is now described with reference to FIGS. 8 to 11. Although the filtering process and the correction process in the above-described first and second embodiments were carried out by calculation, since repeated calculations are performed frequently in these embodiments, the computation cost cannot be ignored.

Thus with the third embodiment, in place of a process by computation, a process equivalent to a process by computation is realized by referencing data in a storage means in which the processing results are stored in advance. The computation cost is reduced significantly thereby and a processing time is reduced. Also, although a binary raster image typically is displayed by the present embodiment, a gray scale image that has been binarized using a suitable threshold value can also be displayed.

Figure 8:
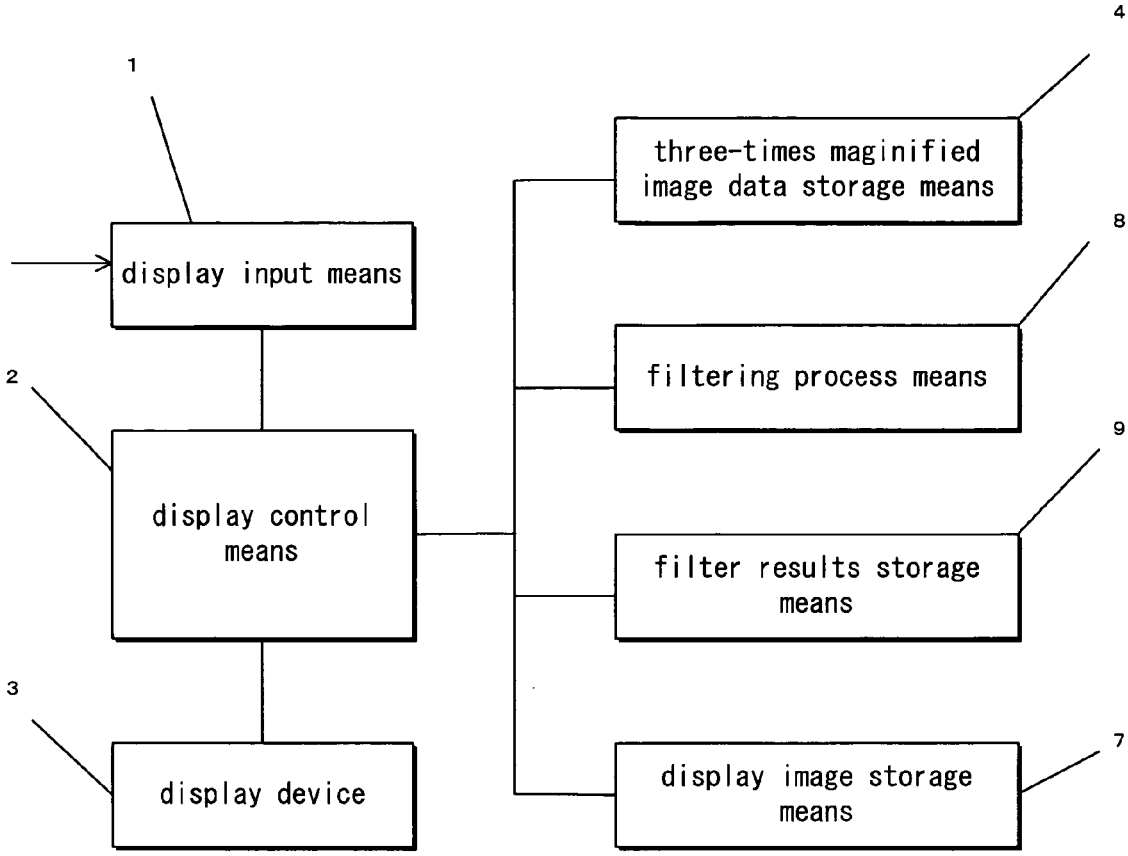
FIG. 8 is a block diagram of a display equipment of a third embodiment of this invention.

FIG. 8 is a block diagram of a display equipment of the third embodiment of this invention. Components that are the same as those of FIG. 1 are provided with the same symbols and descriptions thereof are omitted.

As has been mentioned above, a filtering process means 8 of this embodiment does not perform a filtering process or the computation performed by the correction means 6 of FIG. 1. Instead, the filter results storage means 9 stores the results of the computation prior to input of the display information.

After input of the display information, the filtering process means 8 generates addresses based on the on/off conditions of each of a total of n sub-pixels of the data in the three-times magnified image data storage means 4, which are aligned along the first direction and centered about a target sub-pixel (here, the case where n=3 or n=5 is taken up). The filtering process means references the filter results storage means 9 to obtain the corresponding processing results.

Figure 9:
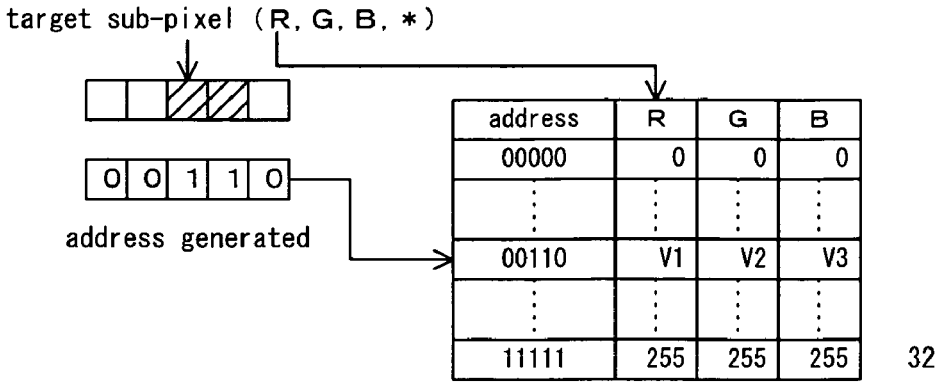
FIG. 9(*a*) is an explanatory diagram of a table in the third embodiment of this invention.

First, the case where n=5 is described with reference to FIG. 9(*a*)–(*e*). As shown in FIG. 9(*a*), the filtering process means 8 determines the target sub-pixel in the raster image (of sub-pixel precision) stored in the three-times magnified image data storage means 4. The on/off information (bit string) of a total of five sub-pixels, which are aligned in the first direction and are centered about the target sub-pixel, are then acquired. In the present embodiment, on is expressed by "1" (by black in the Figure) and off is expressed by "0" (by white in the Figure). This method of expression may be changed as suited.

Upon acquisition of the bit string for the five sub-pixels centered about the target sub-pixel, the value (binary numeral) thereof immediately becomes the address. Here, in the condition shown in FIG. 9(*a*), the address, "00110", is generated.

An offset address may be set as suited for implementation. For simplicity, the offset address is zero (no offset address) in the description below.

As has been described above, the formula used for processing differs between the case where the degrees of contribution to luminance are to be taken into account and the case where the degrees of contribution to luminance are not to be taken into account. Obviously, the degrees of contribution to luminance are preferably taken into account in order to obtain the benefit of improving the display quality.

As has been indicated in the descriptions concerning FIGS. 5(*a*)–(*c*) to 7(*a*)–(*c*), where the degrees of contribution to luminance are to be taken into account, the formula differs according to which of the R, G, and B light-emitting elements the target sub-pixel corresponds to. Thus in this case, the filtering process means 8 checks which of the light-emitting elements the target sub-pixel is. As shown at the right side of FIG. 9(*a*), the processing results for the respective light-emitting elements for R, G, and B are stored for the 32 addresses from "00000" to "11111" in the filter results storage means 9. Here, although the filter results storage means 9 is typically formed of a memory, and as is illustrated, the data are prepared in the form of a table, a list or other storage form may be prepared instead as long as high-speed access is ensured.

Figure 24:
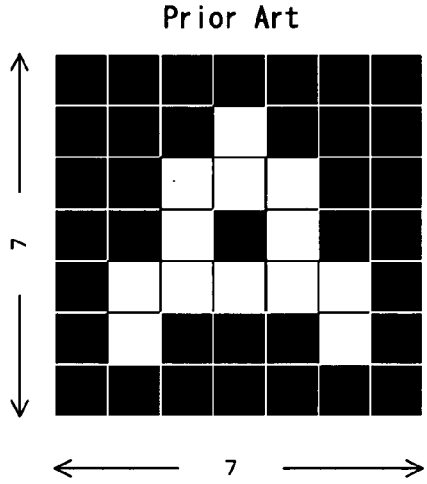
FIG. 24 is an example diagram of an original image of the prior art.
Figure 25:
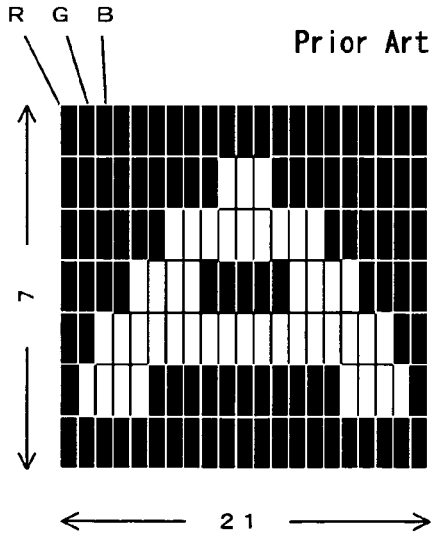
FIG. 25 is an example diagram of a three-times magnified image of the prior art.
Figure 26:
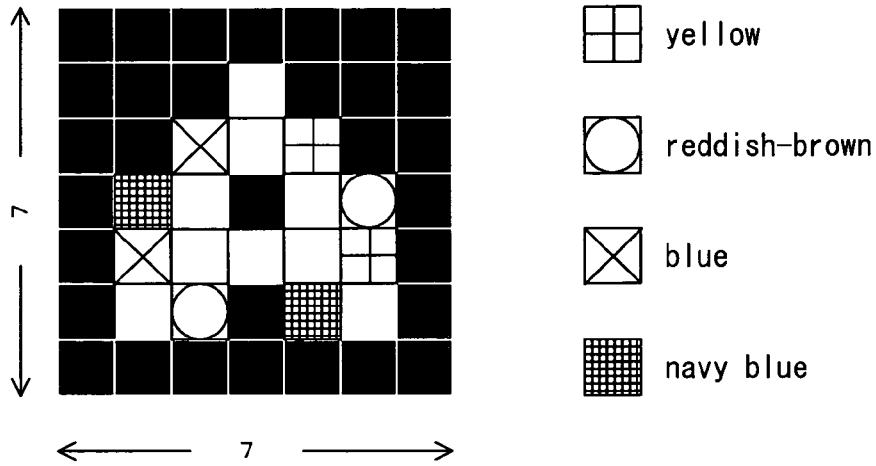
Fig. 26 Prior Art
FIG. 26 is an explanatory diagram concerning the color determination process of the prior art.
Figure 27:
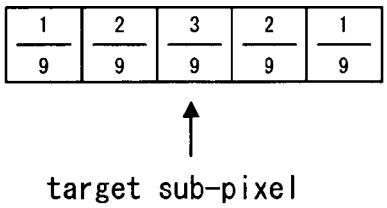
Fig. 27 Prior Art
FIG. 27(*a*) is an explanatory diagram concerning the filtering process factors of the prior art.
Figure 27:
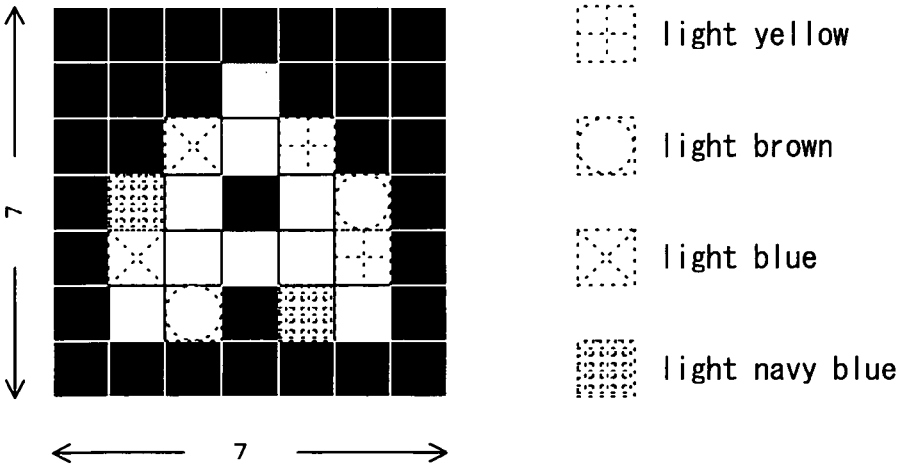
Fig. 27 Prior Art
Figure 28:
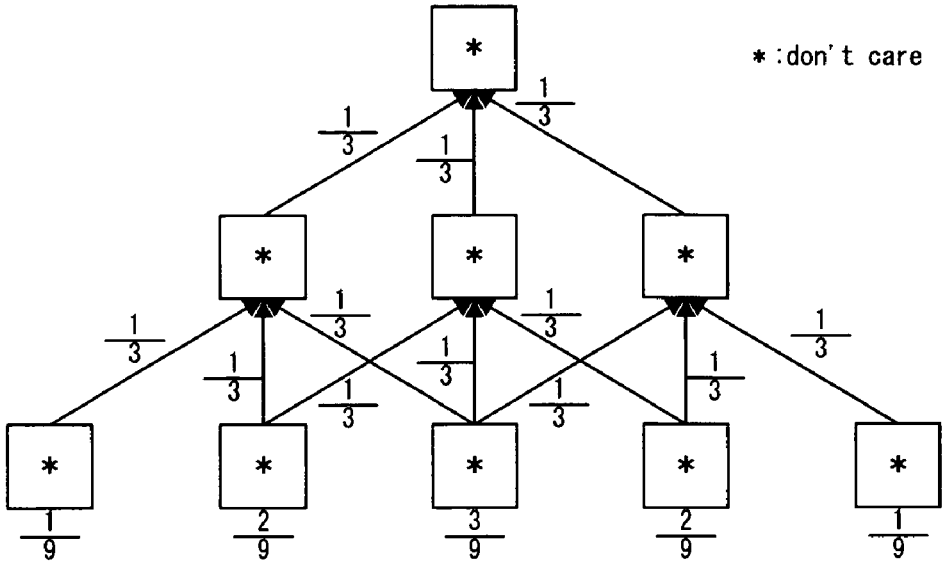
Fig. 28 Prior Art
FIG. 28 is an explanatory diagram concerning the filtering process factors of the prior art.

If the degrees of contribution to luminance are not to be taken into account, since as shown in FIG. 24, there is only one formula regardless of which of the R, G, and B light-emitting elements the target sub-pixel corresponds to, the filtering process means 8 may be arranged to obtain the processing result just from the address obtained from the abovementioned five sub-pixels. However, as in the second embodiment, in the case where the degrees of contribution to luminance are not to be taken into account, a separate correction process is preferably performed in order to improve the display quality.

The details of the filtering process means 8 are now described more specifically with reference to FIGS. 9(*b*) to (*e*). The numerical values in the following description are merely representative examples and may be changed in various ways.

First, when as shown in FIG. 24, the degrees of contribution to luminance are not to be taken into account, just a single processing result is stored in each of the addresses "00000" to "11111" as shown in FIG. 9(*b*).

When the degrees of contribution to luminance are to be taken into account, three processing results (corresponding to the cases where the target sub-pixel is R, G, or B) are stored in each of the addresses "00000" to "11111" as shown in FIG. 9(*c*) to 9(*e*). FIG. 9(*c*) shows the relationship of FIG. 5 in the form of a table. FIG. 9(*d*) corresponds to FIG. 6. FIG. 9(*e*) corresponds to FIG. 7.

Figure 10:
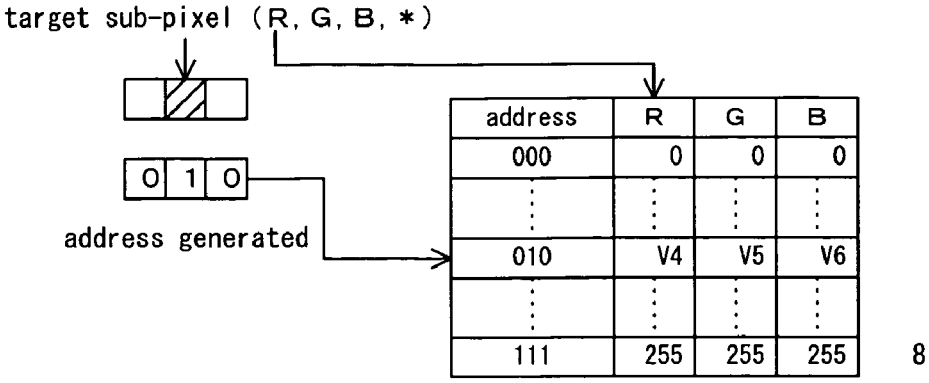
FIG. 10(*a*) is an explanatory diagram of a table in the third embodiment of this invention.

The case where n=3 is now described with reference to FIG. 10(*a*)–(*c*). As shown in FIG. 10(*a*), the filtering process means 8 determines the target sub-pixel in the raster image (of sub-pixel precision) stored in the three-times magnified image data storage means 4. The on/off information (bit string) of a total of three sub-pixels, which are aligned in the first direction and are centered about the target sub-pixel, are then acquired. In the present embodiment, on is expressed by "1" (by black in the Figure) and off is expressed by "0" (by white in the Figure). This method of expression may be changed as suited.

Upon acquisition of the bit string for the three sub-pixels centered about the target sub-pixel, the value (binary numeral) thereof immediately becomes the address. Here, in the condition shown in FIG. 10(*a*), the address, "010", is generated.

As has been described above, the formula used for processing differs between the case where the degrees of contribution to luminance are to be taken into account and the case where the degrees of contribution to luminance are not to be taken into account. Obviously, the degrees of contribution to luminance are preferably taken into account in terms of improving the display quality.

As has been indicated in the descriptions concerning FIGS. 5(*a*)–(*c*) to 7(*a*)–(*c*), when the degrees of contribution to luminance are to be taken into account, the formula differs according to which of the R, G, and B light-emitting elements the target sub-pixel corresponds. Thus in this case, the filtering process means 8 checks which of the light-emitting elements the target sub-pixel is. As shown at the right side of FIG. 10(*a*), the processing results for the respective light-emitting elements for R, G, and B are stored for the 8 addresses from "000" to "111" in the filter results storage means 9.

If the degrees of contribution to luminance are not to be taken into account, as shown in FIG. 24, there is only one formula regardless of which of the R, G, and B light-emitting elements the target sub-pixel corresponds to. In that case, the filtering process means 8 obtains the processing result from just the address obtained from the abovementioned five sub-pixels. However, as in the second embodiment, where the degrees of contribution to luminance are not to be taken into account, a separate correction process is preferably performed in order to improve the display quality.

The details of the filtering process means 8 is now described more specifically with reference to FIGS. 10(*b*) to (*c*). The numerical values in the following description are merely representative examples and may be changed in various ways.

First, when as shown in FIG. 24, the degrees of contribution to luminance are not to be taken into account, just a single processing result is stored in each of the addresses "000" to "111" as shown in FIG. 10(*b*).

When the degrees of contribution to luminance are to be taken into account, three processing results (corresponding to the cases where the target sub-pixel is R, G, or B) are stored in each of the addresses "000" to "111" as shown in FIG. 10(*c*). FIG. 10(*c*) shows the relationship of FIG. 4(*a*)–(*c*) in the form of a table.

Figure 11:
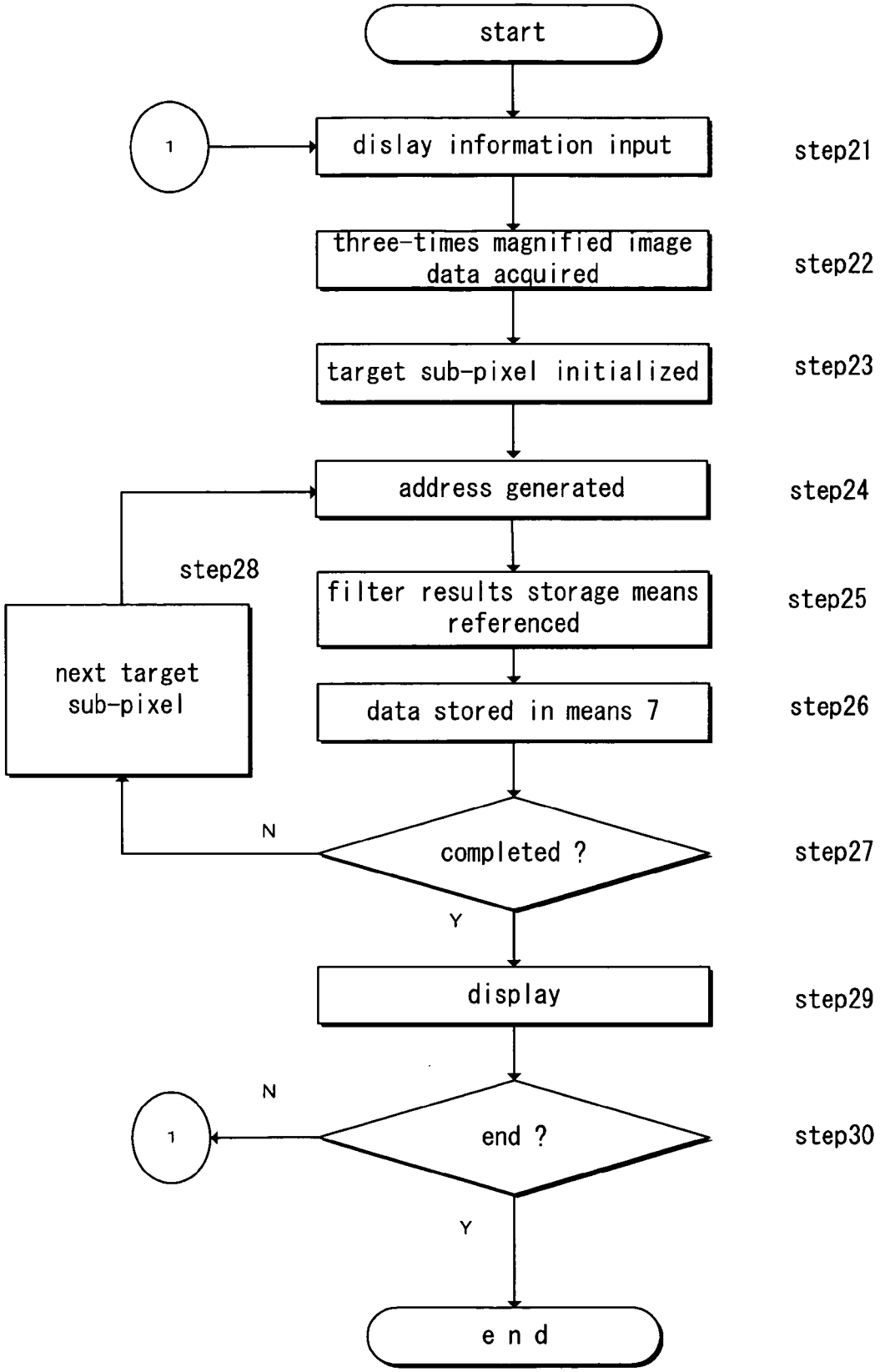
FIG. 11 is a flowchart of the display method of the third embodiment of this invention.

The flow of the display method of this embodiment is now described with reference to FIG. 11. First, in steps 21 to 23, the same processes as those of steps 1 to 3 of FIG. 1 are performed.

Next in step 24, the filtering process means 8 acquires the bit string for the total of n (n=3 or 5) sub-pixels centered about the target sub-pixel from the three-times magnified image data storage means 4 and uses this bit string as an address.

Then in step 25, the above-described table in the filter results storage means 9 is referenced to obtain the processing result of the address. In the case where the degrees of contribution to luminance are to be taken into account, the filtering process means 8 also examines to which of R, G, and B the target sub-pixel corresponds.

Then in steps 26 to 30, the same processes as those of steps 5 to 9 of FIG. 1 are performed.

By the above description it can be understood that processes equivalent to that of the first and second embodiments is realized by the referencing the data stored in the filter results storage means 9. Moreover in this case, the computation amount is reduced significantly and the process is performed faster than the first and the second embodiments.

Fourth Embodiment

The fourth embodiment is now described with reference to FIGS. 12 to 14. The fourth embodiment further develops the third embodiment and the processes are performed at even higher speeds. The components of the fourth embodiment are the same as those of the third embodiment and illustration of these components is omitted.

In comparison to the third embodiment, the fourth embodiment differs in the process performed by the filtering process means 8 and in the stored contents of the filter results storage means 9. Also, although in the descriptions up to that of the third embodiment, the object processed was renewed one sub-pixel at a time, the fourth embodiment renews the object processed one pixel at a time. In other words, the fourth embodiment renews three sub-pixels at a time. These differences are now described by way of a first example and a second example.

FIRST EXAMPLE

Figure 12:
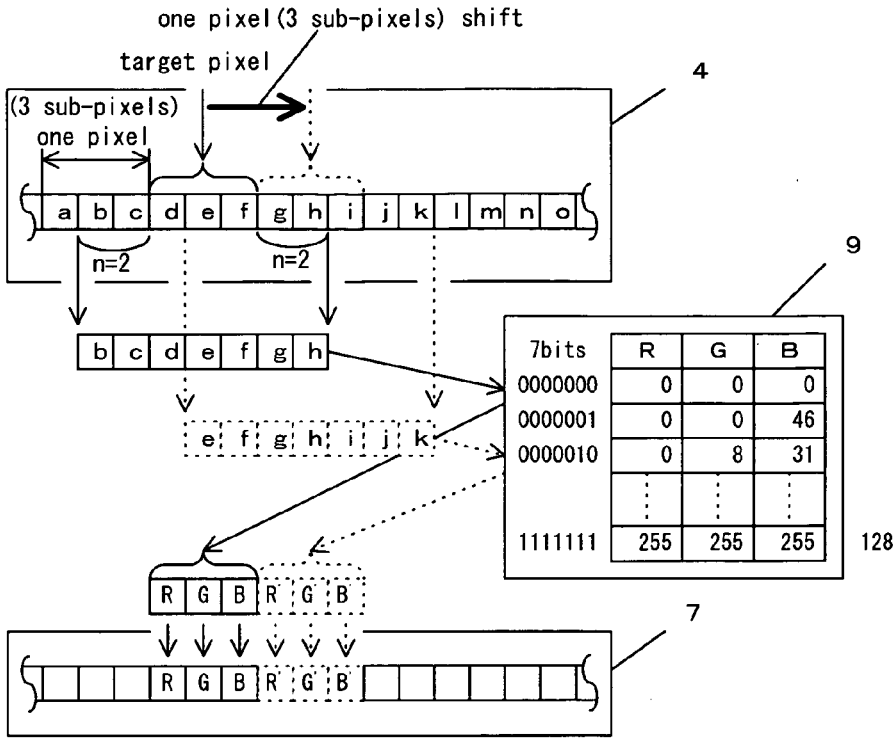
FIG. 12 is an explanatory diagram concerning the filtering process in a fourth embodiment (first example) of this invention.

With this example, the filtering process means 8 references the filter results storage means 9 and performs the processes shown in FIG. 12.

Suppose that at a certain point in time, the target pixel (three sub-pixels are handled together as one) is at the position of the arrow in FIG. 12. In FIG. 12, a single character, such as a, b, c, d, . . . , represents the image data of each corresponding sub-pixel.

In the present case, the image data of the target pixel in the three-times magnified image storage means 4 are "def", the image data of the target pixel one step prior to the image data, "def", are "abc, the image data of the target pixel one step subsequent are "ghi", and the image data "jk . . . " follow thereafter.

In the first example, the image data, "def", of the current target pixel, the image data "bc" of the two prior sub-pixels, and the image data, "gh" of the two subsequent pixels are used. That is, the image data of a total of seven sub-pixels, which are centered about the target pixel and aligned in the first direction, are used.

The filtering process means 8 takes the image data, "bcdefgh" of these seven sub-pixels and converts each of the data to a bit value of "0" or "1".

To be more detailed, when the three-times magnified image data is of a binary image, since the data, "bcdefgh", is a bit string of "0" or "1" from the beginning, the filtering process means 8 uses the image data of the respective sub-pixels as they are or upon bit inversion.

If the three-times magnified image data are of a multi-valued image, the filtering process means 8 generates a binary bit string from the multi-valued image using a previously set threshold value.

In either case, a 7-digit binary bit string is generated. The filtering process means 8 then uses this bit string as a 7-bit address in a manner similar to the third embodiment.

In order to handle this bit string, in the first example, a table in which RGB values are set in correspondence with the 7-bit addresses is prepared as shown in FIG. 12. This table is stored in the filter results storage means 9. Here, if 7-bit addresses are used, 128 combinations of RGB values will suffice.

In other words, by generating a 7-bit bit string centered about the target pixel and using this bit string as an address to reference the table of the filter results storage means 9, the filtering process means 8 can immediately obtain the RGB value, "RGB", of the target pixel. The filtering process means 8 then writes this RGB value, "RGB", into an appropriate area of the display image storage means 7.

When this writing is completed, the filtering process means 8 renews the target pixel by one pixel (three sub-pixels). That is, in the condition shown in FIG. 12, the target pixel is shifted byjust three sub-pixels as indicated by the horizontal arrow in FIG. 12, and for this next target pixel, the next RGB value, "R'G'B'", is written into an area corresponding to the next pixel based on the image data, "efghijk".

By this arrangement, the filter process is performed all at once for a unit of one pixel (three sub-pixels) to enable reduction of the times of address referencing and table search and thereby enable processing at even higher speed.

SECOND EXAMPLE

Figure 13:
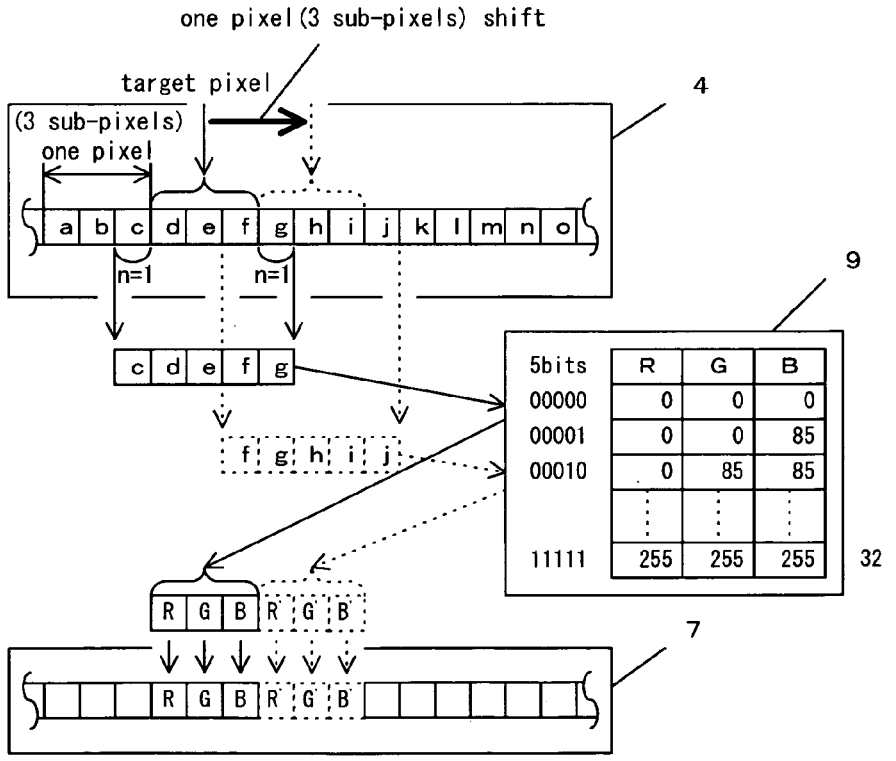
FIG. 13 is an explanatory diagram concerning the filtering process in a fourth embodiment (second example) of this invention.
Figure 14:
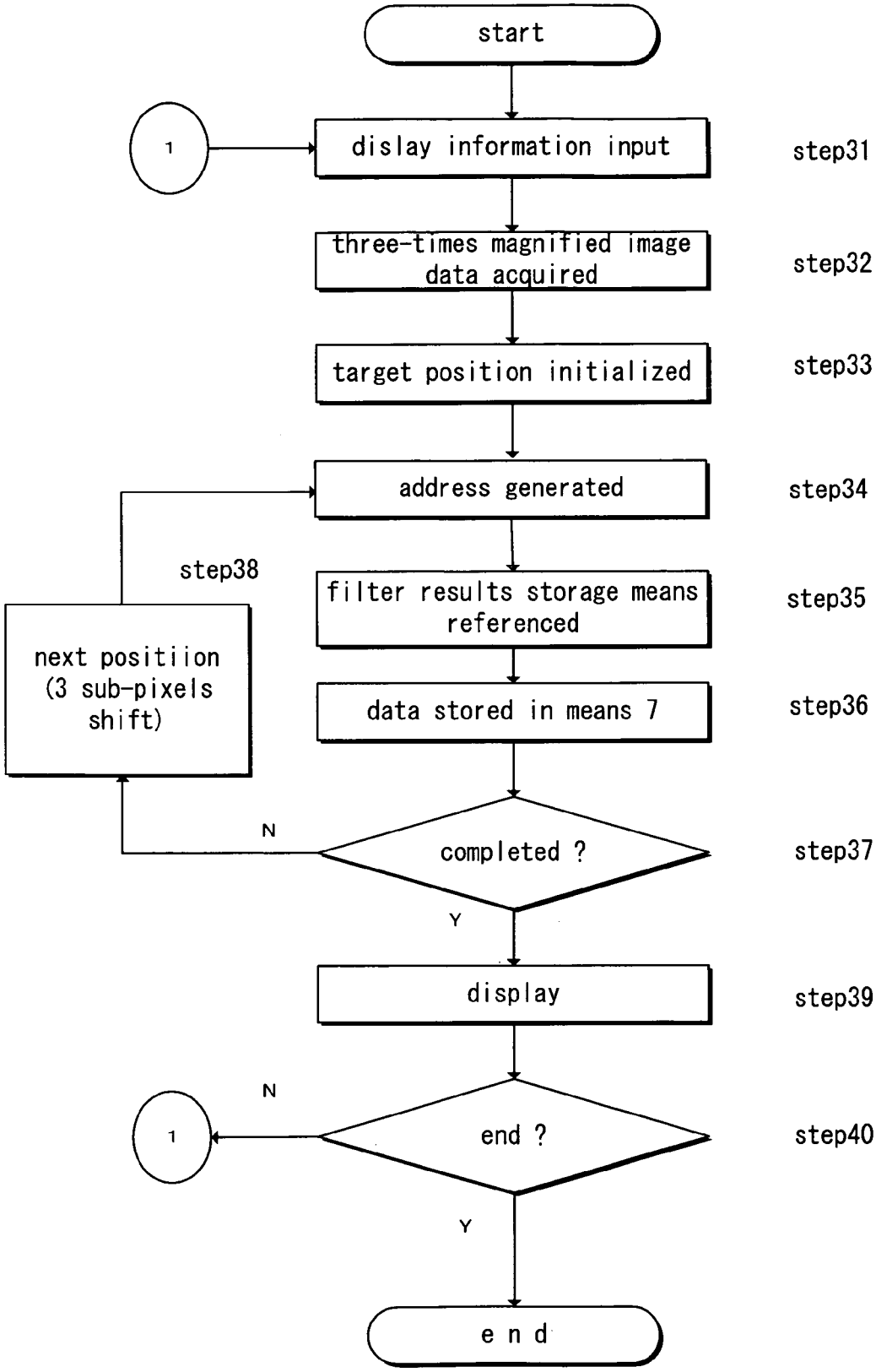
FIG. 14 is a flowchart of the display method of the fourth embodiment of this invention.

With this example, the filtering process means 8 references the filter results storage means 9 and performs the processes shown in FIG. 13.

Suppose that at a certain point in time, the target pixel (three sub-pixels are handled together as one) is at the position of the arrow in FIG. 13. In FIG. 13, a single character, such as a, b, c, d, . . . , represents the image data of each corresponding sub-pixel.

In the present case, the image data of the target pixel in the three-times magnified image storage means 4 are "def", the image data of the target pixel one step prior to the image data, "def", are "abc, the image data of the target pixel one step subsequent are "ghi", and the image data "jk . . . " follow thereafter.

Although, in the first example, the image data of two sub-pixels prior to and two sub-pixels subsequent the image data of the target pixel were used, in the second example, the image data, "def", of the current target pixel, the image data "c" of the prior sub-pixel, and the image data, "g" of the subsequent pixel are used. That is, the image data of a total of five sub-pixels, which are centered about the target pixel and aligned in the first direction, are used.

The filtering process means 8 takes out the image data, "cdefg" of these five sub-pixels and converts each of the data to a bit value of "0" or "1".

To be more detailed, when the three-times magnified image data are of a binary image, since the data, "cdefg", is a bit string of "0" or "1" from the beginning, the filtering process means 8 uses the image data of the respective sub-pixels as they are or upon bit inversion.

Meanwhile, if the three-times magnified image data are of a multi-valued image, the filtering process means 8 generates a binary bit string from the multi-valued image using a previously set threshold value.

In either case, a 5-digit binary bit string is generated. The filtering process means 8 then uses this bit string as a 5-bit address in a manner similar to the third embodiment.

In order to handle this bit string, in the second example, a table in which RGB values are set in correspondence to the 5-bit addresses is prepared as shown in FIG. 13, and this table is stored in the filter results storage means 9.

In other words, by generating a 5-bit bit string centered about the target pixel and using this bit string as an address to reference the table of the filter results storage means 9, the filtering process means 8 immediately obtains the RGB value, "RGB", of the target pixel. The filtering process means 8 then writes this RGB value, "RGB", into an appropriate area of the display image storage means 7.

When this writing is completed, the filtering process means 8 renews the target pixel by one pixel (three sub-pixels). That is, in the condition shown in FIG. 13, the target pixel is shifted by just three sub-pixels as indicated by the horizontal arrow in FIG. 13. For this next target pixel, the next RGB value, "R'G'B'", is written into an area corresponding to the next pixel based on the image data, "fghij".

By this arrangement, the filter process is performed all at once for a unit of one pixel (three sub-pixels) as in the first example to enable reduction of the times of address referencing and table search and thereby enable processing of even higher speed to be realized. Also, in this case where a 5-bit address is used, there are 32 combinations of RGB values and a table size that is smaller than that of the first example is sufficient.

The respective processes of the display method of the fourth embodiment (i.e. both the "first example" and the "second example") are now described with reference to FIG. 14. First in steps 31 to 32, the same processes as those of steps 1 to 3 of FIG. 1 are performed.

However, since the object to be processed is renewed in units of one pixel (three sub-pixels) as has been mentioned above, the target position is initialized in pixel units (step 33).

Next in step 34, the filtering process means 8 acquires a bit string corresponding to a total of n (n=7 or 5) sub-pixels, centered about the target pixel, from the three-times magnified image data storage means 4 and uses this bit string as an address.

Then in step 35, the above-described table in the filter results storage means 9 is referenced and the processing result of the address is obtained.

Then in steps 36 to 40, the same processes as those of steps 5 to 9 of FIG. 2 are performed. However in this embodiment, since the object to be processed is shifted by one pixel (three sub-pixels) in steps 37 to 38, the target position is renewed in pixel units.

Fifth Embodiment

Figure 15:
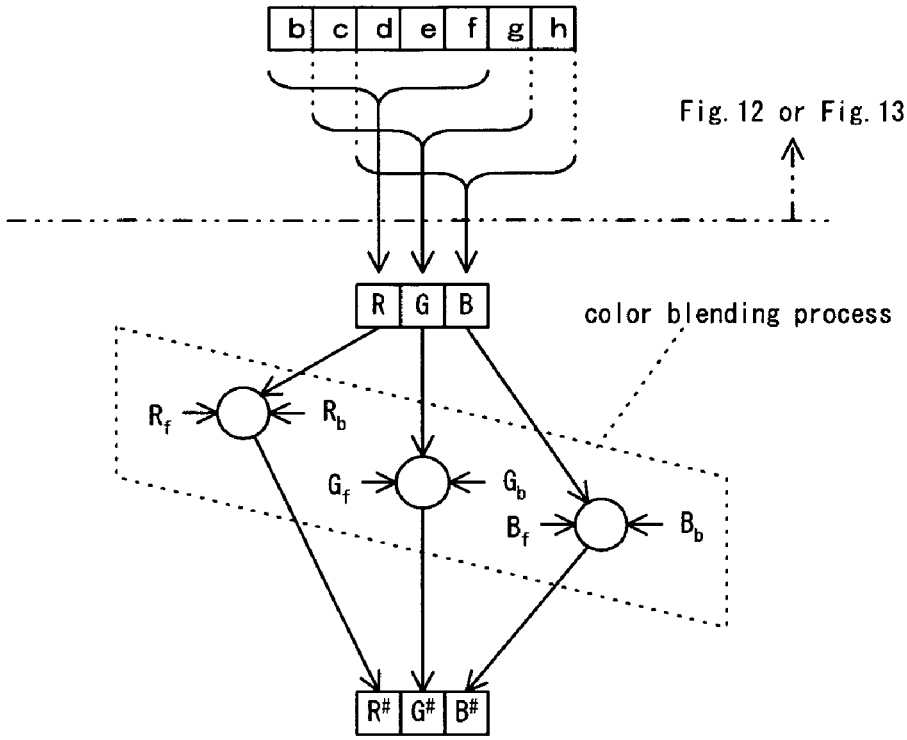
FIG. 15 is an explanatory diagram concerning the color blending process in a fifth embodiment of this invention.

The fifth embodiment of this invention is now described with reference to FIG. 15. With the fifth embodiment, the fourth embodiment is developed further to accommodate color display.

With the fourth embodiment (both the "first example" and the "second example"), the filtering process means 8 obtains the RGB value, "RGB", of the target pixel just by the referencing of a table as has been described using FIGS. 12 and 13.

With the fifth embodiment, the filtering process means 8 performs, in addition to the processes of the fourth embodiment, a process of blending the background color or the foreground color by the formulae (1) to (3) shown below on the RGB value, "RGB", to obtain the RGB value, "R#G#B#", of the target pixel to accommodate for color display.

$$R\#=R\times Rf+(1-R)\times Rb \quad (1)$$

$$G\#=G\times Gf+(1-G)\times Gb \quad (2)$$

$$B\#=B\times Bf+(1-B)\times Bb \quad (3)$$

In formulae (1) to (3), (Rf, Gf, Bf) indicates the foreground color and (Rb, Gb, Bb) indicates the background color.

Obviously, formulae (1) to (3) represent a favorable example, and this invention is not limited to these formulae. For example, various changes, such as providing each color component with a suitable weight, or handling just one of either the foreground color or the background color, etc., may be made.

By performing a color blending process as described above, sub-pixel display that accommodates color display is realized.

Though in the above description, the information supply source, from which the filtering process means 8 obtains the information on one or both of the foreground color and background color, is typically the display information input means 1, the information supply source is not limited thereto and may be selected arbitrarily.

Sixth Embodiment

The components of this embodiment are the same as those of FIG. 1, which concerns the first embodiment. However, the correction means 6 may be omitted.

Also, the filtering process means 5 performs a filtering process on the three-times magnified image stored in the three-times magnified image data storage means 4 and stores the image obtained as a processing result in the display image storage means 7. With this sixth embodiment, the filtering process means 5 performs a filtering process using factors with which the denominator is a power of 2.

Figure 17:
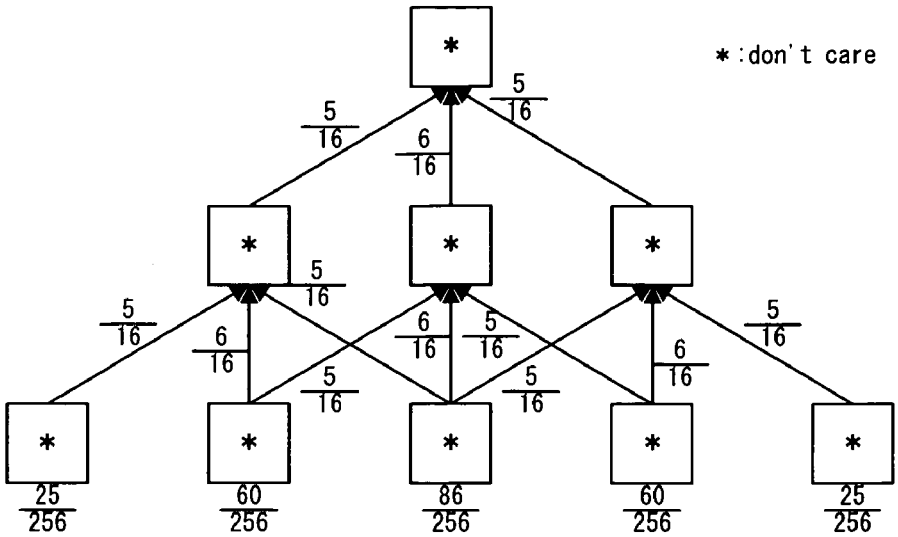
FIG. 17 is an explanatory diagram concerning the filter factors of the sixth embodiment of this invention.

A specific example of these factors is now described with reference to FIG. 17. In the example of FIG. 17, in the first stage, energy corresponding to a factor $6/16$ is allocated to the central sub-pixel and energy corresponding to a factor of $5/16$ is allocated to the sub-pixels to the left and right of the central pixel.

Likewise in the second stage, energy corresponding to a factor of $6/16$ is allocated to the central sub-pixel and energy corresponding to a factor of $5/16$ is allocated to each of the sub-pixels to the left and right of the central pixel.

Since the target sub-pixel can thus be reached from the first stage via a total of three paths at the center, left, and right sides of the second stage, the synthetic factor of the target sub-pixel (obtained by adding together the factors of the first stage and the second stage) is $86/256$.

Also, since a sub-pixel adjacent the target sub-pixel is reached via two paths, the synthetic factor for this sub-pixel is $60/256$.

Furthermore, since a next adjacent sub-pixel can only be reached via a single path, the synthetic factor for this sub-pixel is $25/256$.

The value V(n) after the filtering process is thus:

$$V(n)=(25/256)\times V_{n-2}+(60/256)\times V_{n-1}+(86/256)\times V_n+(60/256)\times V_{n+1}+(25/256)\times V_{n+2}=(25\times V_{n-2}+60\times V_{n-1}+86\times V_n+60\times V_{n+1}+25\times V_{n+2})/256$$

Since shifting by 8 bits in digital arithmetic performs multiplication by $1/256$, the numerator:

$$(25\times V_{n-2}+60\times V_{n-1}+86\times V_n+60\times V_{n+1}+25\times V_{n+2})$$

is determined by integer multiplication and addition. Then the numerator is divided by 256 by the very rapid process of bit shifting by 8 bits.

Since all operations can thus be performed as integer operations, the operations is performed at high speed and is readily incorporated in hardware.

Figure 18:
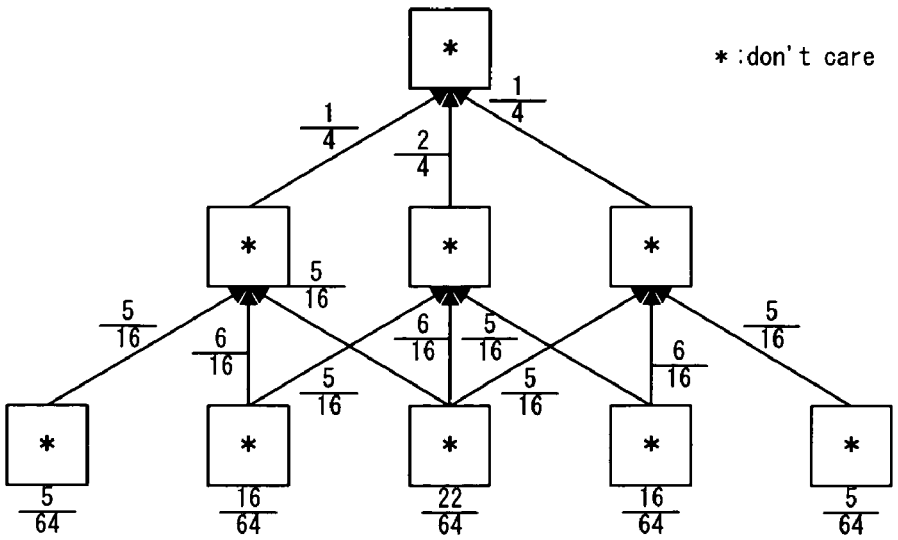
FIG. 18 is an explanatory diagram concerning the filter factors of a modification of the sixth embodiment of this invention.
Figure 19:
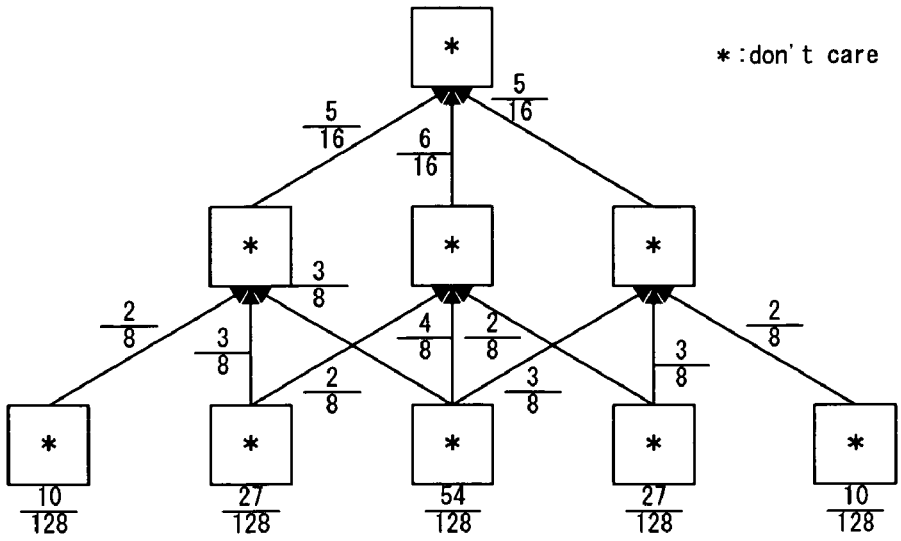
FIG. 19 is an explanatory diagram concerning the filter factors of a modification of the sixth embodiment of this invention.

These factors can be modified in various ways as long as the denominator remains a power of 2. For example, the factors may be set so that the denominator is 64 (6-bit shifting) as shown in FIG. 18 or the factors may be set so that the denominator is 128 (7-bit shifting) as shown in FIG. 19, etc.

Figure 16:
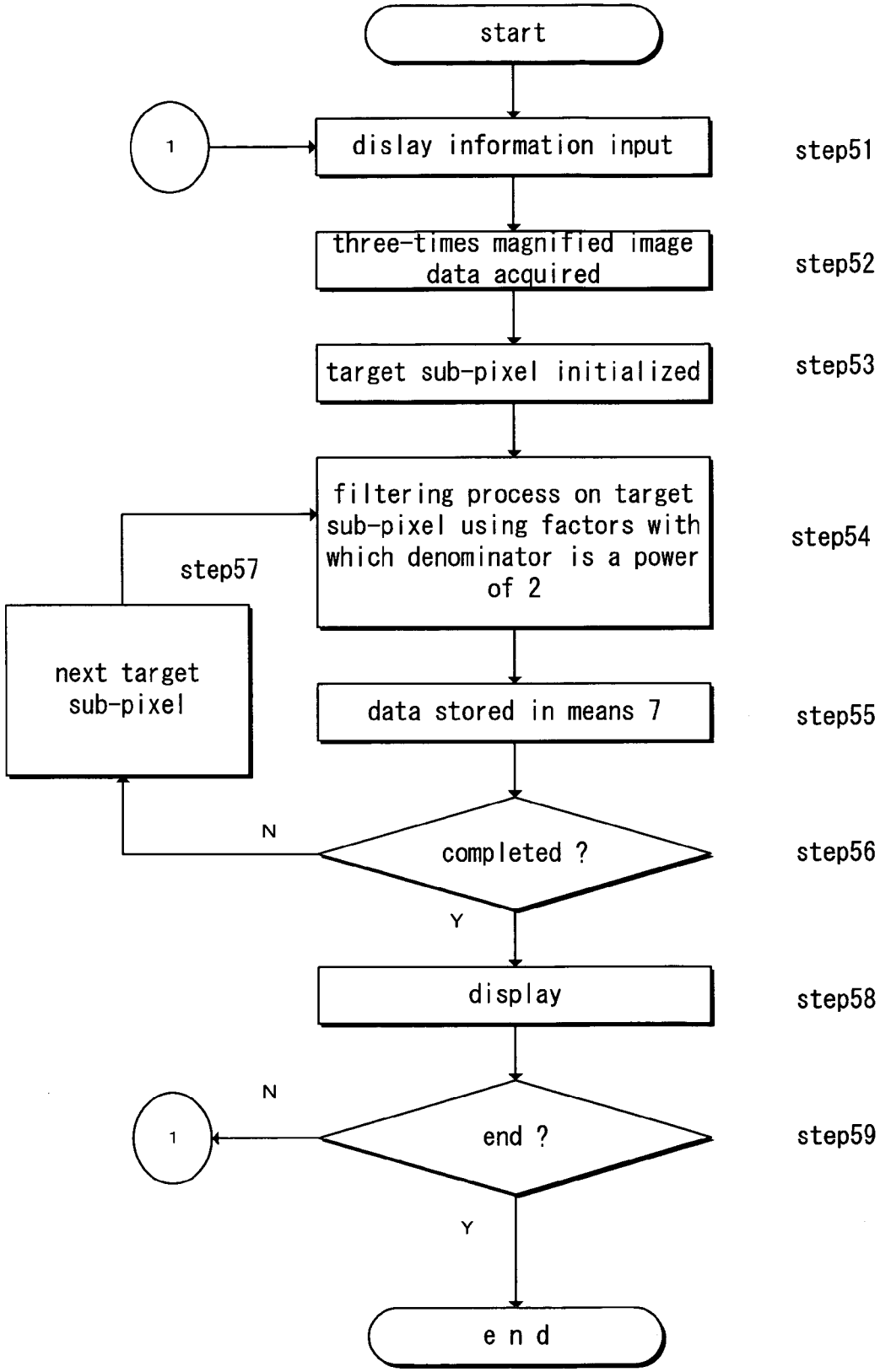
FIG. 16 is a flowchart of the display equipment of the sixth embodiment of this invention.

Based on the above description, the flow of the display method of this embodiment is now described with reference to FIG. 16.

In step 51, the display information is input to the display information input means 1.

In step 52, the three-times magnified image (sub-pixel image) corresponding to the input display information is received from the three-times magnified image data storage means 4. This image is typically a raster font data.

In step 53, the display control means 2 initializes the target sub-pixel in the acquired three-times magnified image to the initial position at the upper left, and in step 54, the filtering process means 5 performs the filtering process on the target sub-pixel using factors in which the denominator is a power of 2. Here, the factors of any of FIGS. 17 to 19 may be used as the filtering process factors.

After completion of the filtering process, the filtering process means 5 returns the processed image data to the display control means 2. The display control means 2 stores the received data in the display image storage means 7 (step 55).

The display control means 2 repeats the processes from step 54 to step 55 while renewing the target sub-pixel (step 57) until the process is completed for all target sub-pixels (step 56).

When these repeated processes are completed, the display control means 2 allocates, on the basis of the display image stored in the display image storage means 7, the three-times magnified pattern to the three light emitting elements that form one pixel of the display device 3 and enables the display device 3 to perform display at the sub-pixel display level (step 58).

Then if the display is not completed (step 59), the display control means 2 returns the process to step 51.

This sixth embodiment provides the following effects.

Since sub-pixel rendering is performed by performing a filtering process using factors in which the denominator is always a power of 2, not only can color irregularities be limited but high-speed processing is realized by integer computation and bit shifting. Moreover, since the method is easily realized in hardware, it is extremely advantageous for incorporation in an LSI, etc.

Seventh Embodiment

Figure 20:
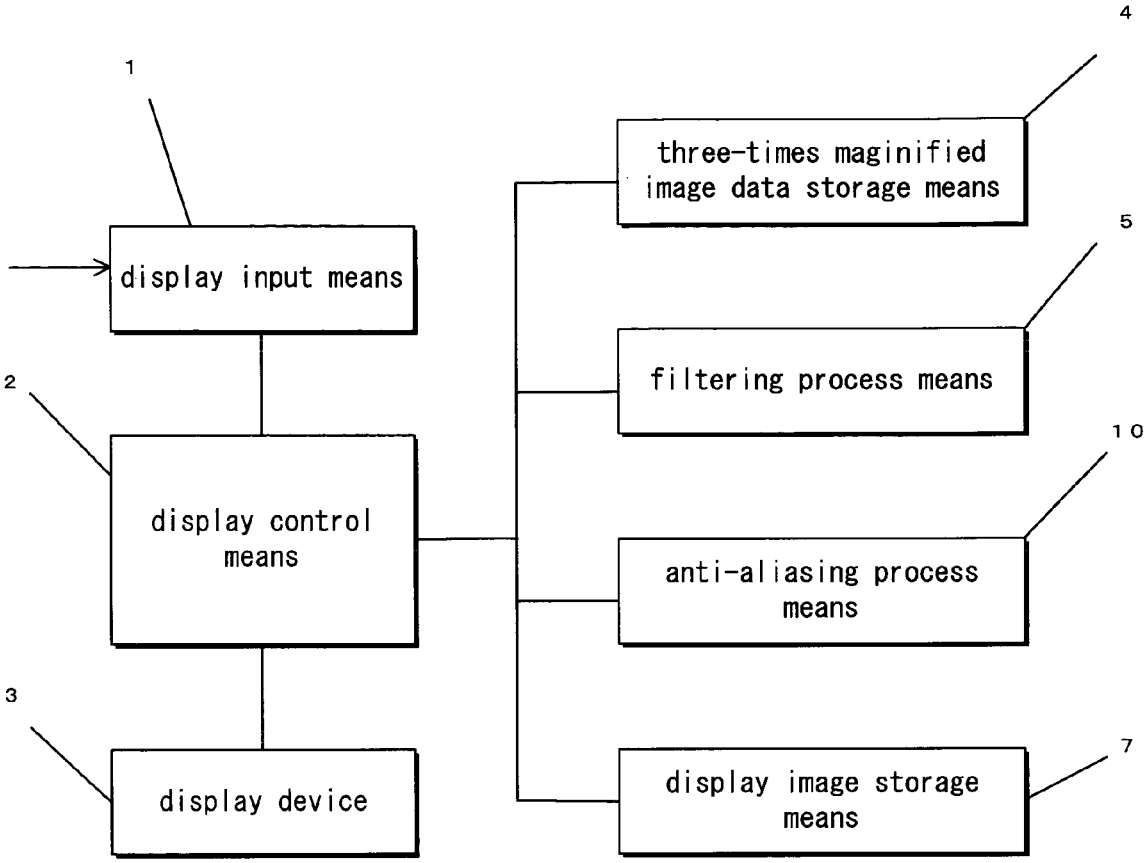
FIG. 20 is a block diagram of the display equipment of a seventh embodiment of this invention.

The components of the seventh embodiment are as shown in FIG. 20. This embodiment differs from the first embodiment shown in FIG. 1 in that an anti-aliasing process means 10 is included.

The anti-aliasing process means 10 performs an anti-aliasing process in only the second direction, which is orthogonal to the first direction, on the three-times magnified image stored in the three-times magnified image storage means 4 after the processing by the filtering process means 5 has been performed and stores the image obtained as a processing result in the display image storage means 7. The anti-aliasing process means 10 does not perform the anti-aliasing process in the first direction.

Figure 21:
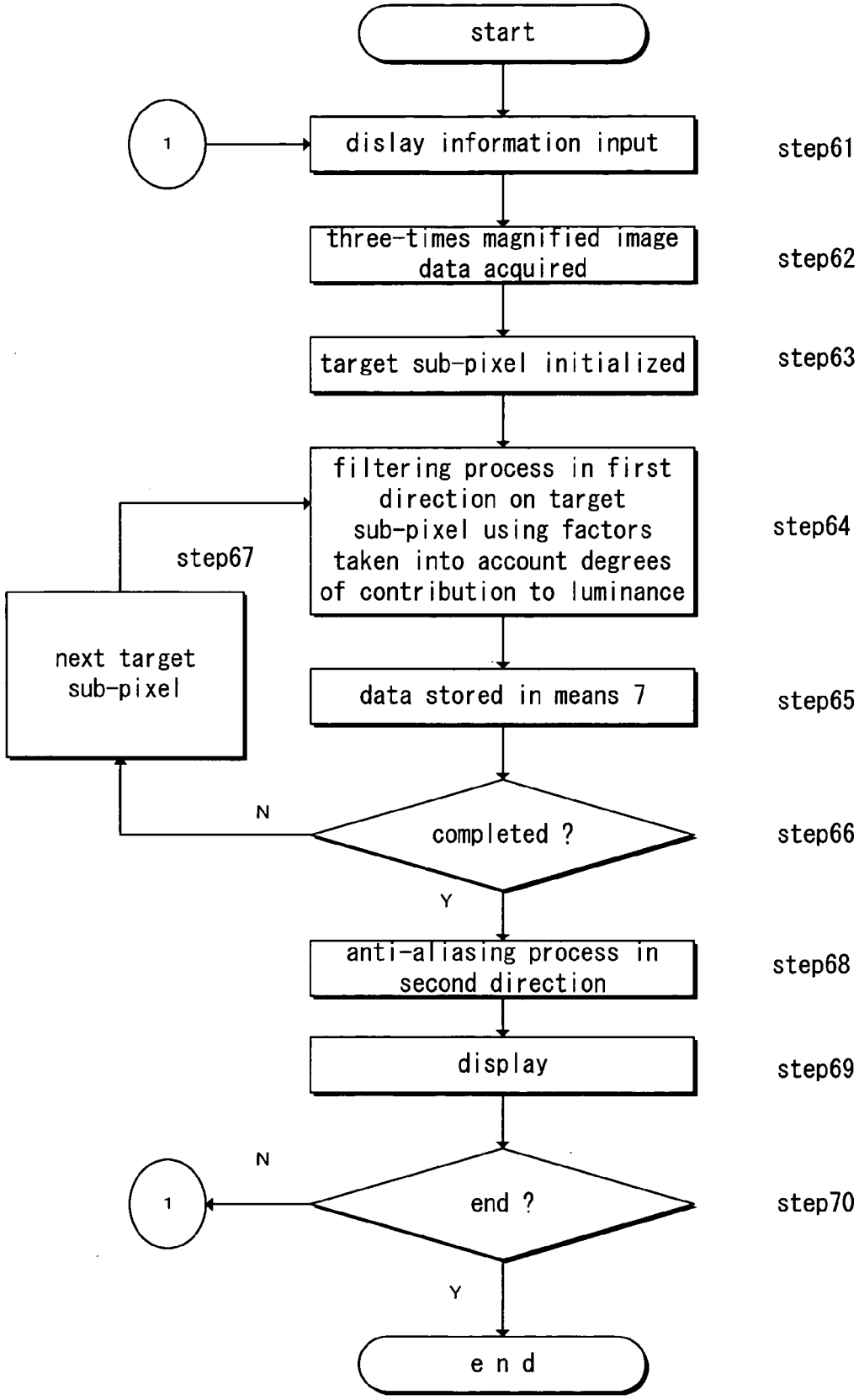
FIG. 21 is a flowchart for the display equipment of the seventh embodiment of this invention.

The flow of the display method of this embodiment is now described with reference to FIG. 21. First, in step 61, the display information are input to the display information input means 1.

The three-times magnified image (sub-pixel image) corresponding to the input display information is then taken from the three-times magnified image data storage means 4 (step 62). This image is typically raster font data.

Next in step 63, the display control means 2 initializes the target sub-pixel in the acquired three-times magnified image to the initial position at the upper left. In step 64, the filtering process means 5 performs the filtering process in the first direction on the target sub-pixel using factors that have taken into account the degrees of contribution to luminance. Any of the factors of the first embodiment may be used as the filtering process factors.

After completion of the filtering process, the filtering process means 5 returns the processed image data to the display control means 2. The display control means 2 stores the received data in the three-times magnified image data storage means 4.

The display control means 2 repeats the processes from step 64 to step 66 while renewing the target sub-pixel (step 67) until the process is completed for all target sub-pixels (step 66).

When these repeated processes are completed, the anti-aliasing process means 10 performs, in step 68, an anti-aliasing process in the second direction on the three-times magnified image data that have been subject to the filtering process and stores the processed image data in the display image storage means 7.

The display control means 2 then allocates, on the basis of the display image stored in the display image storage means 7, the three-times magnified pattern to the three light emitting elements that form one pixel of the display device 3 and enables the display device 3 to perform display (at the sub-pixel display level) (step 69).

Then if the display is not completed (step 70), the display control means 2 returns the process to step 61.

A display example concerning the processing of the character, "A", which is mentioned in the "Related Art" section, is now described with reference to FIGS. 22(*a*)–(*c*). With this example, the image is formed of 12 pixels in the vertical direction and 12 pixels (36 sub-pixels in the case of sub-pixel precision) in the horizontal direction. The first direction as indicated in this specification is the horizontal direction and the second direction is the vertical direction. It should be understood that though this image is originally a multi-value color image, since the colors had to be reduced to the two colors of black and white due to drawing restrictions, the original multi-value color image is increased in brightness and is shown as a simulated graduated display formed by the error diffusion method. It is herein added that a comparison using the original multi-value color image shows that the display example by the present invention is clearly improved in visibility in comparison to the display example by the prior art.

Figure 22:
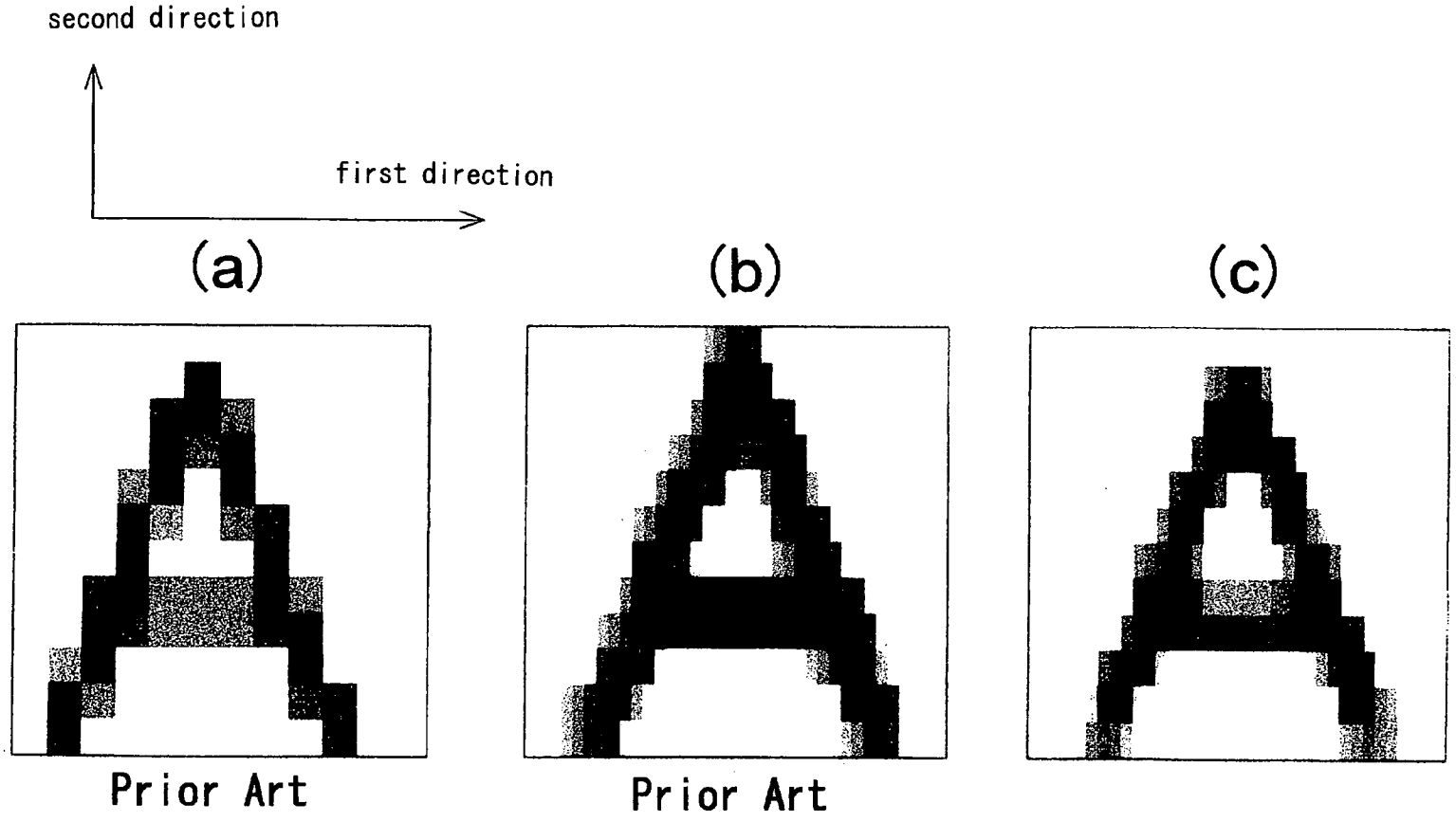
FIGS. 22(*a*) and (*b*) are example diagrams of displays by the prior art.
Figure 23:
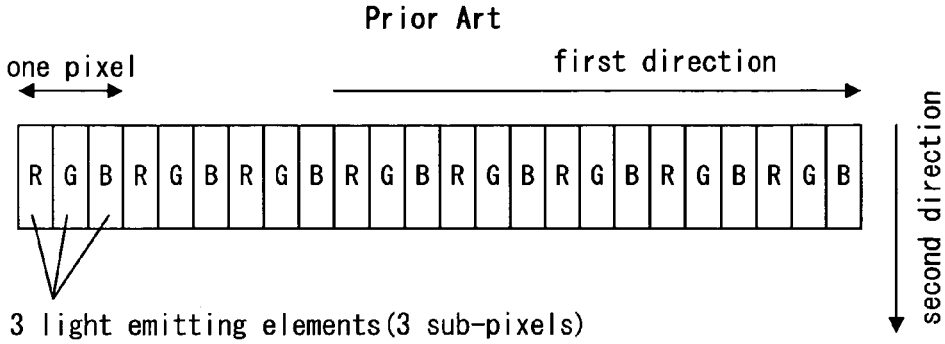
FIG. 23 is a schematic diagram of one line of the prior art.

The image shown in FIG. 22(*b*) is a result of processing by the sub-pixel technique described in the "Related Art" section. A comparison of the image of FIG. 22(*b*) and the image of FIG. 22(*a*) (with which an anti-aliasing process was simply performed on both the first and second directions) shows that the image of FIG. 22(*b*) exhibits less jaggedness along the diagonal edges. Also, with the example of FIG. 22(*a*), since the horizontal bar in the character "A" is blurred, there may be confusion as to whether the character is an "A" or a reverse "V".

It can thus be evaluated that FIG. 22(*b*) is somewhat improved in visibility in comparison to FIG. 22(*a*).

However, a careful look at FIG. 22(*a*) shows that the top part of the character, "A", is elongated more than necessary and the horizontal bar in the character "A" is made abnormally thick by the solid display.

With regard to these points, with FIG. 22(*c*), which is an image by this invention (that is an image with which, after performing the filtering process in the first direction, the anti-aliasing process is performed only in the second direction and in which the anti-aliasing process in the first direction was not performed intentionally), the top part of "A" is not elongated excessively and the horizontal bar of "A" is not excessively thick. That is, the image of FIG. 22(*c*) is improved in accuracy with respect to the character, "A". Put in another way, the appearance of the image is improved in comparison to the images of FIGS. 22(*a*) and 22(*b*).

The following effect is provided by the seventh embodiment.

The blurring as well as the jaggedness of the image is reduced even for a narrow display area to provide excellent visibility in comparison with the normal sub-pixel display.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display method which performs display with a display device, comprising:

aligning three light-emitting elements, which respectively emit light of three primary colors of R, G, and B, in a fixed order in a fixed direction to form one pixel;

aligning a plurality of pixels in said first direction to form one line;

aligning a plurality of such lines in a second direction that is orthogonal to said first direction to form a display screen;

setting factors for the three primary colors of R, G, and B that are different from each other in accordance to degrees of contribution to luminance of the three primary colors of R, G, and B;

obtaining three-times magnified image data;

said three-times magnified image data being formed of sub-pixels;

magnifying a raster image to be displayed currently by three in said first direction;

performing a filtering process on said three-times magnified image data based on the set factors for the three primary colors of R, G, and B; and allocating sub-pixels of said three-times magnified image data that have been subject to said filtering process to said three light-emitting elements that form a pixel to thereby enable said display device to perform display.

2. A display method as set forth in claim 1, further comprising performing said filtering process in two stages.

3. A display method as set forth in claim 1, further comprising performing said filtering process in two stages.

4. A display method as set forth in claim 1, further comprising setting at least part of said factors so that R:G:B=3:6:1.

5. A display method as set forth in claim 1, further comprising setting at least part of said factors based on characteristics of said display device.

6. A display method as set forth in claim 1, further comprising performing said filtering process on a total of three sub-pixels centered about a target sub-pixel.

7. A display method as set forth in claim 1, further comprising performing said filtering process on a total of five sub-pixels centered about a target sub-pixel.

8. A display method which performs display with a display device, comprising:

aligning three light-emitting elements, which respectively emit light of three primary colors of R, G, and B, in a fixed order in a first direction to form one pixel;

aligning a plurality of pixels in said first direction to form one line;

aligning a plurality of lines in a second direction that is orthogonal to said first direction to form a display screen;

setting factors for the three primary colors of R, G, and B that are different from each other in accordance to degrees of contribution to luminance of the three primary colors of R, G, and B;

obtaining three-times magnified image data;

said three-times magnified image data being formed of sub-pixels and with which a raster image to be displayed currently;

said three-time magnified image data being magnified by three in said first direction;

performing a filtering process on said three-times magnified image data based on factors that ignore degrees of contribution to luminance of said three primary colors of R, G, and B, to provide a high speed and high quality display;

performing, based on the set factors for the said three primary colors of R, G, and B, a correction process on said sub-pixels of said three-times magnified image data that have been subject to said filtering process; and allocating said sub-pixels of said three-times magnified image data that have been subject to said correction process to said three light-emitting elements that form a pixel to thereby enable said display device to perform display.

* * * * *

UNITED STATES PATENT AND TRADEMARK OFFICE

CERTIFICATE OF CORRECTION

PATENT NO. : 7,136,083 B2
APPLICATION NO. : 09/908164
DATED : November 14, 2006
INVENTOR(S) : Tadanori Tezuka et al.

It is certified that error appears in the above-identified patent and that said Letters Patent is hereby corrected as shown below:

Column 3; Line 64; Delete “ofthe” and insert -- of the --, therefor.

Column 15; Line 59; Delete “byjust” and insert -- by just --, therefor.

Column 21; Line 41; In Claim 2, delete “two stages.” and insert -- one stage. --, therefor.

Signed and Sealed this

Tenth Day of April, 2007

JON W. DUDAS
*Director of the United States Patent and Trademark Office*